US006592436B1

(12) United States Patent
Abe et al.

(10) Patent No.: US 6,592,436 B1
(45) Date of Patent: Jul. 15, 2003

(54) GRINDING AND POLISHING TOOL FOR DIAMOND, METHOD FOR POLISHING DIAMOND, AND POLISHED DIAMOND, SINGLE CRYSTAL DIAMOND AND SINGLE DIAMOND COMPACT OBTAINED THEREBY

(75) Inventors: Toshihiko Abe, Miyagi-ken (JP); Hitoshi Hashimoto, Miyagi-ken (JP); Shu-Ichi Takeda, Kanagawa (JP)

(73) Assignees: Japan as represented by Director General of Agency of Industrial Science and Technology, Tokyo (JP); Applied Diamond Inc., Kanagawa (JP)

( * ) Notice: Subject to any disclaimer, the term of this patent is extended or adjusted under 35 U.S.C. 154(b) by 0 days.

(21) Appl. No.: 09/565,295

(22) Filed: May 4, 2000

(30) Foreign Application Priority Data

| | | |
|---|---|---|
| May 12, 1999 | (JP) | 11-130991 |
| Aug. 2, 1999 | (JP) | 11-218850 |
| Nov. 11, 1999 | (JP) | 11-320523 |
| Jan. 21, 2000 | (JP) | 2000-012479 |

(51) Int. Cl.[7] ..... B24B 7/00; B24B 9/00
(52) U.S. Cl. ..... 451/64; 428/408; 428/469
(58) Field of Search ..... 428/408, 469; 451/64

(56) References Cited

U.S. PATENT DOCUMENTS

| | | | | |
|---|---|---|---|---|
| 4,124,401 A | * | 11/1978 | Lee et al. | 51/307 |
| 4,439,237 A | * | 3/1984 | Kuminitsu et al. | |
| 5,330,701 A | * | 7/1994 | Shaw et al. | 75/351 |

FOREIGN PATENT DOCUMENTS

| | | | |
|---|---|---|---|
| JP | 51-151887 | | 12/1976 |
| JP | 59-107847 | | 6/1984 |
| JP | 7-237127 | * | 9/1995 |
| JP | 9-262771 | * | 10/1997 |
| JP | 11-071198 | | 3/1999 |

OTHER PUBLICATIONS

Patent Abstracts of Japan, One page English Abstract of JP 11–071198.

Patent Abstracts of Japan, One page English Abstract of JP 59–107847.

Patent Abstracts of Japan, One page English Abstract of JP 51–151887 and one page of English translation of claim of JP 51–151887.

* cited by examiner

*Primary Examiner*—Archene Turner
(74) *Attorney, Agent, or Firm*—Howson and Howson

(57) ABSTRACT

A tool for grinding and polishing diamond and a method for polishing diamond in which a single crystal diamond, a diamond thin film, a sintered diamond compact and the like can be polished at low temperatures without causing cracks, fractures or degradation in quality therein. The tool and method provide a polishing operation which is easy to accomplish, provides stable polishing quality, and provides decreased costs while maintaining stable grinder performance. The grinder is formed of a main component which is an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W. The diamond polishing method includes pushing the above stated grinder against the diamond, and rotating or moving the grinder relative to the diamond while keeping the portion of the diamond subjected to polishing at room temperature. Alternatively, the portion of the diamond subjected to polishing can be heated to a temperature within the range 100–800° C.

1 Claim, 11 Drawing Sheets

GRINDING AND POLISHING TOOL FOR DIAMOND, METHOD FOR POLISHING DIAMOND, AND POLISHED DIAMOND, SINGLE CRYSTAL DIAMOND AND SINGLE DIAMOND COMPACT OBTAINED THEREBY

FIELD OF THE INVENTION

The present invention relates to a tool for grinding and polishing diamond and a method for polishing diamond and/or the materials containing diamond without causing cracks and fractures therein. The diamond can be a polycrystalline diamond, a single crystal diamond, a sintered diamond compact, or a diamond thin film including a diamond thin film formed on a substrate by a gas phase synthetic method or a diamond self-standing film, foil or plate. The present invention also relates to a polished diamond including a diamond thin film, a polycrystalline diamond, etc., a polished single crystal diamond, and a polished sintered diamond compact obtained by the grinder and polishing method.

BACKGROUND OF THE INVENTION

Diamond thin films which have recently attracted considerable attention are one of the materials which utilize diamond. Diamond thin films (ie. a diamond thin film formed on a substrate and a diamond thin-film coating member) and diamond self-standing films each consist of diamond polycrystalline grains that have been produced industrially (artificially) by a gas phase synthetic method (CVD method) or the like. However, diamond thin films obtained by the above synthetic method consist of a great number of crystal grains and have a rough surface.

Thus, the rough surface of a diamond thin film formed by a gas phase synthetic method must be planarized before its use in, for example, electronic parts, optical parts, super precision parts, or machining tools.

Further, although a natural single crystal diamond and an artificial single crystal diamond formed by, for example, a high pressure synthetic method or a gas phase synthetic method are currently being used as various kinds of industrial materials, such as a grinder dresser, cutting tool, die, heat sink, and x-ray window, or used as a jewel, the diamonds require finishing to an appropriate shape suitable for their respective applications.

As for a sintered diamond compact utilizing diamond, its characteristics are being made full use of and are becoming widely used in tools for high-speed precision grinding or polishing of automobile engines, tools for precision grinding or polishing of cemented carbide, grinding or cutting tools, wear-resistant parts, heat sinks or packages for communication instruments, etc.

The sintered diamond compacts usually contain Co, WC, TiC, etc. as a binder additive; however, some contain little or no binder additive. Unless otherwise specified, "diamond sintered compacts" used herein include sintered compacts containing Co, WC, TiC, etc. as a binder additive or sintered compacts containing little or no binder additives.

It is easily understood that polishing diamond is not easy since diamond is extremely hard. It is so hard that it is commonly used for polishing other hard materials such as metals and ceramics or for fine-polishing jewelry.

As a method for planarizing a polycrystalline diamond thin film or a free-standing diamond film which each have a large amount of roughness on their surfaces, a Scaife method is utilized in which the diamond films are polished with diamond powders intervened between the diamond film and a hard cast iron plate rotating at a high speed (ie. grinding and polishing using a diamond).

This method has been used for polishing diamond as a jewel; however, as a method for polishing the foregoing artificial diamonds, its processing efficiency is extremely low and it is therefore not used.

In particular, for the foregoing diamond single crystal, its hardness varies dramatically from crystal plane to crystal plane or from orientation to orientation. The crystallographic planes which can be polished are limited to, for example, the (100) and (110) planes under present conditions, and it is extremely difficult to polish the (111) plane which is superior to any other planes in hardness and thermal conductivity. In actuality, it has been considered that it is substantially impossible to polish that crystal plane.

Thus, polishing a diamond single crystal requires such great skill that polishing is carried out while examining the crystallographic planes and orientation to locate the plane to be possibly polished. This has led to making diamond polishing complicated and expensive.

As for the sintered diamond compacts, when employing a polishing method using a diamond grinder (ie. grinding and polishing using a diamond) described above, an intense step (about several $\mu$m) is likely to occur due to a difference in hardness at grain boundaries between diamond and binder or between neighboring diamond grains, or due to a falling of many diamond grains in the sintered compact. Thus, when using a sintered diamond compact as a machining tool as described above, grinding accuracy decreases. When using the same as a wear-resistant part, the problem of deterioration in fracture properties arises, and even the problems of damage to the sintered diamond compact and falling of diamond grains in the sintered diamond compact arise.

As described above, a diamond is so hard a material that there is no substitute for it; therefore, it is only natural to consider that there is no abrasive for diamond except diamond itself (ie. grinding and polishing using diamond). Thus there have been devised grinders for polishing diamonds in which a diamond abrasive for grinding and polishing using a diamond are embedded in different kinds of binders.

Examples of such grinders include a resin bonded diamond wheel utilizing phenol resin, a metal bonded diamond wheel, a vitrified bonded diamond wheel utilizing feldspar/quartz, and an electroplated diamond grinding wheel.

The basic concept of the above methods is to scratch the surface of the diamond subject to polishing with diamond abrasive. Unless otherwise specified, "diamond" used herein means diamond itself as well as materials containing diamond, such as, diamond thin films, free-standing diamond films, single crystal diamonds, sintered diamond compacts, and polycrystalline diamonds other than the above. Thus, the wear resistance of the diamond abrasives and the amount of diamond abrasives are the points determining the processing efficiency of the grinders. In addition, any type of binder used as the holder of diamond grains must not present an obstacle to the polishing, and a new cutting edge diamond abrasive grain must appear on the polishing surface every time an old one becomes worn.

One example of the above methods is such that a new cutting edge of diamond abrasive appears automatically according to the amount of the diamond abrasive worn out in a grinder by anodic oxidation of the bond, the grinder binder such as cast iron, with the development of the wear of the diamond abrasive. In this case, as long as the diamond abrasive exists which can effectively polish the subject of polishing, iron oxide is formed on the surface of the binder so as to prevent it from being electrolyzed.

This method is considered to be the most efficient among the foregoing. However, even this method still gives rise to problems, such as complicated operation, high cost and unstable polishing quality. For high-quality diamond powders to be suitable for use as an abrasive in the above method, a suitable binder must be selected. The selected binder must be embedded in the grinder and the quality of the same must be maintained; electrolysis equipment and setting of its conditions are required; and polishing operation and its control are also required. The quality of polishing is determined by all of the above.

When the material being polished is a diamond thin film, the polishing rate and the polishing efficiency are limited due to the number of diamond grains in the material being polished being overwhelmingly large compared with the number of diamond grains of the abrasives applied during the polishing process.

As described above with the method for polishing diamond utilizing a grinding and polishing tool for diamond, problems have still persisted involving the intensive wear of the grinder and the need of an expensive polishing apparatus which is extremely accurate and which can withstand elevated pressures.

There is proposed a method, other than the foregoing, of polishing diamond by pressing iron or stainless steel against it. Although diamond is chemically stable at room temperature, it is graphitized and begins to bum when heated to 700° C. in the air, and even in an evacuated atmosphere, it is graphitized when heated to 1400° C. or higher. The above method for polishing diamond utilizes the reaction of diamond with iron at such high temperatures.

It has been understood that the reaction of diamond with iron (carbon, which is the component of diamond, decompose into melts) begins to occur at about 800° C. to form $Fe_3C$ (cementite) which is peeled off at a polished plane during the polishing process, and the peeling of $Fe_3C$ causes the development of the polishing.

This reaction is further facilitated at elevated temperatures, at which the formation/decomposition of $Fe_3C$ occurs, diamond begins to take a form of carbon dioxide, and polishing is developed. Generally, the reaction temperature needs to be 900° C. or higher taking into account the polishing efficiency.

This method has been considered to be acceptable in that it can use iron or iron-based materials which provide an inexpensive abrasive. The most serious problem in this method, however, is that an efficient polishing can be achieved only by heating the polishing tool or material to be polishing to high temperatures. Stainless steel and iron-based materials are softened at high temperatures and their strength is markedly deceased, which makes stable polishing impossible.

Polishing must be carried out in an evacuated atmosphere or in a reductive atmosphere so as to prevent the iron from being oxidized, especially when using iron at high temperatures. Thus, other problems arise relating to the facilities and to complicating the polishing process (ie. polishing cannot be carried out freely and easily).

In addition, such high temperature heating as described above affects even the diamond which is the subject of polishing and causes cracks and fractures in the subject diamond due to the thermal stress caused by an abrupt temperature gradient during fracture and heating.

An attempt has been made to replace iron with chromium and titanium, both of which have a strong affinity with carbon. However, chromium is too brittle to be subjected to polishing, and titanium is too soft and, like iron, easily oxidized to form titanium oxides. Thus, both cannot be used as an abrasive.

Laser polishing has also been attempted as an alternative; however, its accuracy of dimension is poor and it is therefore not useable.

OBJECT OF THE INVENTION

Accordingly, an object of the present invention is to provide a tool for grinding and polishing diamond and a method for polishing diamond which enables the polishing of diamond itself or the materials containing diamond, such as, single crystal diamond, diamond thin film including a diamond thin film formed on a substrate by a chemical-vapor deposition or a free-standing diamond film (foil or place), sintered diamond compact, and polycrystalline diamond other than the foregoing, at low temperatures (including room temperature) without causing cracks, fractures, or degradation in quality therein. The tool and method should enable the use of currently existing apparatus including surface grinding apparatus, lap grinding apparatus and other polishing apparatus while maintaining stable abrasive performance. The tool and method should further provide for ease of operation while providing a stable polishing quality at a low cost. Another object of the present invention is to provide a diamond, such as a single crystal diamond or a sintered diamond compact, having been subjected to the above stated grinder and method.

Another object of the present invention is to provide efficient and inexpensive grinding and polishing processing of diamond thin film components of three-dimensional shape and diamond thin film coating components which are expected to rapidly increase in the near future with the development of diamond thin film applications.

SUMMARY OF THE INVENTION

The present inventor found that special metal materials can react with diamond effectively, be polished at low temperatures or ordinary temperature or under heating, and control the wearing and deterioration of abrasives extremely even in the atmospheric air.

Based on this finding, the present invention provides a tool (ie. grinder) for grinding and polishing diamond. The main component of the grinder is an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W.

According to another aspect of the present invention, a tool for grinding and polishing diamond is provided according to the above description, and wherein the content of the intermetallic compound in the grinder is 90 percent by volume or greater.

According to another aspect of the present invention, a tool for grinding and polishing diamond is provided according to either of the above descriptions, and wherein a part of the grinder or the whole grinder is made of the above stated intermetallic compound.

According to another aspect of the present invention, a method for polishing diamond is provided. The diamond is polished on a grinder whose main component is an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W, while heating the portion subjected to polishing to 100–800° C., or more preferably, to between 300–500° C.

According to another aspect of the present invention, the content of the intermetallic compound in the grinder utilized in the above described method is 90 percent by volume or greater.

The present invention further provides a polished diamond, single crystal diamond, and sintered diamond compact. The diamond, single crystal diamond, and sintered diamond compact have each been subjected to a polishing process on a grinder whose main component is an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W.

According to another aspect of the present invention, a polished diamond is provided having a step at a grain boundary portion of 0.1 $\mu$m or smaller when the thickness of the diamond thin film exceeds 300 $\mu$m, and 0.02 $\mu$m or smaller when the thickness of the same is 300 $\mu$m or thinner.

According to another aspect of the present invention, a single crystal diamond polished on the above stated grinder is provided wherein the polishing plane of the single crystal diamond is a (111) plane.

According to another aspect of the present invention, a sintered diamond compact polished on the above stated grinder is provided wherein the surface roughness of the sintered diamond compact after polishing is 0.5 $\mu$m or less.

According to yet another aspect of the present invention, a composite grinding and polishing tool for grinding and polishing diamond and a segment of the same, wherein the composite grinding and polishing tool and the segment of the same is a composite of an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W, diamond abrasive, and a cemented carbide or ceramics.

Unless otherwise specified, "intermetallic compound" used herein includes a composite intermetallic compound.

DETAILED DESCRIPTION OF THE PREFERRED EMBODIMENTS AND METHODS

Figure 1:
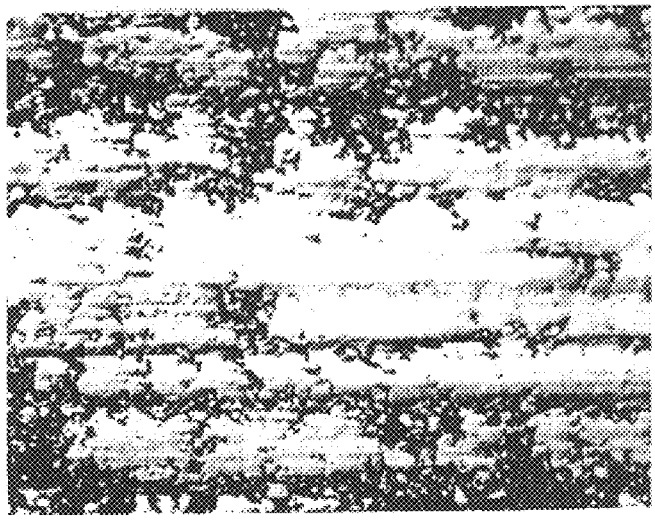
FIG. 1 is a differential interference microphotograph of the surface of a diamond thin film having been polished on a TiNi intermetallic compound polishing grinder of example 1 at room temperature for 1 minute.

A tool for grinding and polishing diamond provided by the present invention can be produced by, for example, a powder metallurgy method. To this end, one kind or more of powders are selected as material powders from the group of Ti, V, Zr, Nb, Mo, Hf, Ta and W and one kind or more of powders are selected as material powders from the group of Al, Cr, Mn, Fe, Co, Ni, Cu, Ru, Rh, Pd, Os, Ir and Pt. The material powders each have an average particle diameter of 150 $\mu$m or smaller, preferably 10 $\mu$m or smaller, and are prepared in such a manner that each intermetallic compound to be formed has the same composition and the same ratio as those of the intermetallic compound grinder of the present invention. The material powders are mixed in a ball mill and dried to a powder mixture. Hereinafter, unless otherwise specified, these material powders are referred to as "powder for a grinder", and the intermetallic compound includes "the compound whose intermetallic compound content is 90 volume percent or higher."

As a material powder, a fine atomized powder can be utilized. The powder for a grinder previously alloyed in a given ratio by a mechanically alloying method can also be utilized.

A sintered compact has a high density when sintering is carried out using a fine and uniform powder mixture, which advantageously leads to the production of a uniform and dense grinder.

These powders may be an elemental metal powder, a previously alloyed powder (an intermetallic compound) or a composite powder thereof.

The above milled powder mixture is first subjected to preforming in a mold. After that, it is subjected to, for example, cold isostatic pressing treatment (CIP treatment), followed by hot press sintering (HP treatment) at 1000–1300° C. under a pressure of 500 Kgf/cm$^2$, or it is subjected to CIP treatment followed by hot isostatic pressing treatment (HIP treatment) at 1000–1300° C. under a pressure of 500 Kgf/cm$^2$, so that a sintered compact of high density is produced. Preferably, the relative density is 99 percent or higher.

The temperature, pressure, and other processing conditions under which CIP treatment, HP treatment, and HIP treatment are conducted are not limited to the foregoing. Rather, other conditions can be set taking into account the kinds of materials used, the density of the sintered compact to be obtained, etc.

Alternatively, a sintered compact can be produced by a pulse discharge sintering method in which a powder mixture is filled into a graphite mold, compacted between upper and lower punches (electrodes) while heated by applying pulse current to the electrodes. This method can be used in place of conducting CIP treatment, HP treatment and HIP treatment described above. In this case, the use of the above mechanically alloyed powder provides a dense and more uniform sintered compact.

The alloy polishing grinder of the present invention whose main component is an intermetallic compound can be produced using melting methods such as vacuum arc melting, plasma melting, electron beam melting and induction melting. When conducting such melting, a considerable amount of gas, in particular, oxygen, is incorporated into the material. In addition, aluminum and titanium, the elements constituting an intermetallic compound as described above, have a strong tendency to combine with oxygen. Accordingly, melting must be conducted in an evacuated atmosphere or in an inert gas atmosphere.

The alloy grinder castings having the intermetallic compound as a main component tend to be inferior in mechanical strength to sintered alloy grinders having the same main component. Accordingly, when producing such castings, the occurrence of segregation and the generation of coarse-grains must be prevented in the process of melting and solidification by controlling the production temperature.

The sintered compact or the ingot obtained from the above powder metallurgy or melting methods is cut into grinder shapes each of which is finished to a shape suitable for a grinder, such as, a surface grinding machine or a lap grinding machine. The sintered compact or casting is given its final shape and is fixed with a component, such as, an alloy grinder holding member, so as to become a grinding and polishing tool for a diamond.

Turning now to the subject of polishing, the polishing of a diamond thin film or a free-standing diamond film is described as an example. The diamond thin film or the free-standing diamond film can be formed by well-known chemical-vapor deposition (CVD).

Chemical-vapor deposition includes, for example, a method in which diamond is deposited on a substrate heated to 500° C.–1100° C. from a diluted mixed gas of hydrocarbon gas, such as methane, and hydrogen introduced through an open quartz tube set at a position close to tungsten heated to a high temperature of about 2000° C.; a microwave plasma CVD, an RF (radio-frequency) plasma CVD, or a DC (direct current) arc plasma jet method utilizing plasma discharge instead of the above tungsten; and a method in which diamond is decomposed and deposited from a hydrocarbon-containing gas (oxygen-acetylene) by letting the above gas flame strike a substrate in atmospheric air at high speed.

The present invention is applicable to the diamond thin film or the diamond self-standing film formed by the foregoing methods or methods other than the foregoing.

A natural diamond and an artificial diamond can also be polishing easily. It is believed that the (111) plane of a diamond single crystal cannot be polishing with known techniques; however, the grinder of the present invention provides such marvelous performance that it can complete the polishing of the (111) plane in just several short minutes.

Due to the techniques which enable the polishing of a (111) plane of a diamond single crystal, the high-quality (111) plane can be utilized as a cutting face for cutting tools. In addition, high performance and value added diamond single crystals can be obtained, for instance, a high performance single crystal diamond dresser using the (111) plane as a precision truer for a grinder and highly thermal conductive heat sink.

According to the present invention, even when the subject of polishing is a sintered diamond compact, an extremely high quality polishing can be achieved. The difference in hardness at grain boundaries between diamond and binder or between diamond grains, or the step due to falling off of diamond abrasive as observed in the use of the polishing method using a diamond polishing grinder (ie. grinding and polishing using diamond), does not occur. Accordingly, the problem of grinding and polishing caused by the above step does not arise.

Further, according to the present invention, an extremely uniform polishing can be achieved even to a sintered diamond compact; accordingly, the problem of deterioration in fracture properties, which tends to occur when diamond is used as wear-resistant parts, does not arise.

With a grinder of the present invention, diamond is polished by pushing the grinder against the diamond while allowing the grinder to rotate or move relative to the diamond and by keeping the portion subjected to polishing at room temperature (ordinary temperature) or heating the same to 100–800° C.

When the thickness of the diamond thin film or the like formed on a substrate in the above manner is small, for example, about 10 $\mu$m, and since the step on the surface of the diamond is several $\mu$m, the resistance to polishing is small and polishing can be carried out satisfactorily at ordinary temperature.

At points where diamond comes in contact with the grinder, the temperature is raised locally and considerably by frictional heat. Under such conditions, carbides, carbonitrides or the like of the components of the grinder of the present invention (Al, Cr, Mn, Fe, Co, Ni, Cu, Ru, Rh, Pd, Os, Ir and Pt, or Ti, V, Zr, Nb, Mo, Hf, Ta and W), such as TiC, TiAlC and TiAlCN, are formed and are eventually peeled. Presumably, this effectively promotes the progress of polishing diamond (chemical polishing).

On the other hand, when the thickness of the diamond thin film is thick and the crystal grain diameter is also large (film thickness of several tens $\mu$m or larger, grain diameter of several $\mu$m-several tens $\mu$m), although the resistance to polishing is increased, polishing is carried out effectively by applying heat.

When applying heat, polishing is carried out while heating the grinder and/or at least a part of the portion subjected to polishing and controlling the temperature of the portion to 100–800° C. as described above.

When the heating temperature from outside is lower than 100° C., the toughness of the alloy grinder is not satisfactory, and cracking including chipping are likely to occur in the grinder. On the other hand, diamond itself is also heated to almost the same temperature as the grinder by the above heating and by frictional heat. If the temperature exceeds 800° C., cracks or fractures occur more often in the diamond due to the diamond being heat-affected, and thus, the diamond is likely to be damaged. Thus, the heating temperature needs to be controlled so that it does not exceed 800° C. The suitable heating temperature is 300–800° C.

The total heat applied to the portion subjected to polishing from outside is controlled to fit in the above temperature range. Although temperature must be set taking into account the temperature increase by frictional heat, an abrupt temperature increase exceeding 800° C. is not a problem. The heating temperature set in the present invention does not include such an abrupt temperature increase.

The grinding and polishing tool for diamond of the present invention is characterized by an extremely high hardness at room temperature relative to stainless steel. While the hardness of the intermetallic compound polishing grinder of the present invention obtained by powder metallurgy techniques is Hv 500–1000 Kg/mm$^2$, that of stainless steel is only about Hv—200 Kg/mm$^2$. In other words, the strength of the intermetallic compound polishing grinder of the present invention reaches 2.5 to 5 times that of stainless steel.

Further, the intermetallic compound polishing grinder of the present invention does not significantly lose its hardness even at high temperatures, and it has an advantageous property that its hardness increases with temperature until the temperature reaches about 600° C.

More importantly, the grinding and polishing tool for diamond of the present invention shows a marvelous wear resistance against diamond. This is readily understood from the fact that the amount of chipping on wearing of the grinder is smaller than that of cemented carbide (WC+16% Co: Hv—1500 Kg/mm$^2$) whose hardness is much higher than the grinder.

The grinding and polishing tool for diamond of the present invention is suitable for polishing diamond because of its relatively small amount of chipping or wearing, and in addition, it has a characteristic of markedly increasing the wear of diamond.

As for Ti when it is used independently, although it promotes reaction with carbon, it becomes softer with an increase in temperature, especially in atmospheric air where it readily oxidizes to form titanium oxides and hardly serves as an abrasive.

However, polishing can be carried out without experiencing cracks and fractures by using the grinding and polishing tool of the present invention in such a manner as to push the grinder into contact with the diamond and rotate or move the same relative thereto while keeping the portion of the diamond subjected to polishing at room temperature or heating the same to 100–800° C.

When carrying out polishing and applying heat from outside, a heating temperature range which is particularly effective is 300–500° C. Diamond is heat-affected by the above application of heat to become more reactive with the grinding and polishing tool. Thus, the reaction of carbon, which is a component of diamond, with Ti, which is a component of the grinder, becomes easier and leads to effective chipping on fracture of fine projections from diamond crystal grains.

In the production process of diamond thin films described above when forming a particularly thick diamond thin film, polishing becomes significantly difficult since diamond crystal grains become coarser and the roughness of the surface of the diamond crystal becomes more intense. However, such a hard-to-polish diamond can also be polished easily without causing cracks, fractures, and extreme wear in the grinder by using the grinder of the present invention and by carrying out the polishing while heating the portion subjected to polishing to 100–800° C. Further, it has been confirmed that the application of heat in the above temperature range strengthens the grain boundaries of the alloy grinder, and thereby grain boundary fractures or cracks become hard to occur therein.

Presumably, at points where diamond comes into contact with the grinder, TiC, TiAlC, TiAlCN, etc., are formed due to the frictional heat and the heating from outside sources. This causes an intensive chemical polishing, and thereby the polishing of diamond is allowed to progress.

The grinding and polishing tool of the present invention is naturally applicable to other methods for polishing diamond by taking advantage of the remarkable characteristics thereof. All these applications are within the scope of the present invention.

When producing a grinding and polishing tool which consists of a simple intermetallic compound, there sometimes exists an individual component element of the above intermetallic compound as a simple element, or there is sometimes mixed a trace of impurities, as components other than the intermetallic compound. Even in such a case, the grinder can fully exhibit the function as a grinder as long as it contains 90 volume percentage or higher of the intermetallic compound of the present invention.

As described, the grinder of the present invention can be used with elements constituting the intermetallic compound (metal), elements other than those constituting the above intermetallic compound or alloys, cemented carbides, semimetal elements, nonmetallic elements, ceramics (including glass), diamond abrasive or organic compounds (polymers) combined or mixed with it. Accordingly, the grinder containing 90 volume percentage or higher of the intermetallic compound of the present invention is shown merely to illustrate a suitable example of a grinder using the above intermetallic compound as a simple compound and is not intended to limit the grinder of the present invention.

For example, one kind of more of elements selected from the group of Al, Cr, Mn, Fe, Co, Ni, Cu, Ru, Rh, Pd, Os, Ir and Pt or one kind or more of elements selected from the group of Ti, V, Zr, Nb, Mo, Hf, Ta and W, each of which is a main element constituting the intermetallic compound of the present invention, or elements other than the above ones can be added in order to increase the strength or the toughness of the grinding and polishing tool comprising the intermetallic compound of the present invention.

Among various kinds of intermetallic compounds, there are some kinds which are too brittle to be used for a grinder independently. However, their strength and toughness can be improved by combining them with the materials which can improve strength or toughness or by forming composite intermetallic compounds with other intermetallic compounds. Accordingly, the intermetallic compound which cannot be used independently can be used for a grinder if they take the form as described above. All the grinders containing the above intermetallic compounds and the above materials are also included in the present invention.

Further, ceramics, diamond or cemented carbides can be added in order to improve the hardness of the grinding and polishing tool. All these grinders containing ceramics or cemented carbides are also included in the present invention.

Further, according to the present invention, a part or the whole of the grinding and polishing tool can be composed of the above intermetallic compounds, which enables great improvement in the functions of a grinder. Those grinders include, for example, a composite grinder in which intermetallic compounds bound a diamond abrasive, like currently used ones; a composite grinder of the intermetallic compound of the present invention and ceramics; a composite grinder of the intermetallic compound and metal or cemented carbide or the like in which the above intermetallic compound is used as an abrasive; and the complex thereof.

As described above, in the production of a composite grinder or a mixed grinder, the formulation of the above materials (volume percentage) and the volume percentage of the binder used are optionally selected according to its processing purposes or applications and are not limited to a specific formulation or volume percentage. Further, the above grinder can be used jointly with part of the currently used grinder segment. All these are included in the present invention.

The applications of the diamonds whose surface has been planarized by the easy and highly accurate polishing method of the present invention are effectively increased as a diamond material of high performance. In particular, a single crystal diamond can be used as a high performance single crystal diamond dresser, a highly thermoconductive heat sink, etc.; a sintered diamond compact can be used as a precise sintered diamond compact machining tool or as wear-resistant parts; and a diamond thin film or free-standing diamond film obtained according to the present invention can be used as a material suitable for electronic devices such as a circuit substrate, radio-frequency device, heat sink, various types of optical parts, surface acoustic wave element (filter), flat display, semi-conductor and radiation sensor, precision mechanical parts and various types of sliding parts.

EXAMPLES AND COMPARATIVE EXAMS

The present invention will be more clearly understood with reference to the following examples and comparative examples. However, these examples are intended to aid in the understanding of the present invention and are not to be construed to limit the present invention. Variations and other examples made without departing from the spirit and scope of the present invention are included in the present invention.

Grinder and Production Conditions Thereof

One kind or more of powders selected from the group of Ti, V, Zr, Nb, Mo, Hf, Ta and W and one kind or more of powders selected from the group of Al, Cr, Mn, Fe, Co, Ni, Cu, Ru, Rh, Pd, Os, Ir and Pt were mixed in a ratio which enables the formation of the intermetallic compounds of the present invention. The mixed material powders (2–10 $\mu$m) were filled into a ball mill to undergo milling for 100–300 hours into mechanically alloyed powders. The alloyed powders were sintered under a pressure of 50 MPa at 950° C. for 5 minutes by pulse discharge sintering, so as to provide each sintered intermetallic compound compact grinder.

Subject of Polishing

A diamond thin film formed on a polycrystalline Si substrate 4 mm thick using a $H_2/CH_4$ gas mixture by a hot filament method; the thickness of the diamond thin film: 10 μm (the step is several μm or smaller), 300 μm, 500 μm; and the dimension: 19 mm×19 mm;

a sintered diamond compact; and a diamond single crystal.

Polishing Condition for Grinder temperature: room temperature (15–30° C.) or the diamond portion subjected to polishing heated to 100–800° C.;

rotation speed: 400–3000 rpm;

shape of grinder: ϕ30 mm;

pushing load: 1 kgf–10 kgf;

duration: 1–10 minutes.

Example 1

A $TiFe_2$ intermetallic compound polishing grinder was produced under the foregoing conditions, and the foregoing diamond thin film was polished at room temperature using the above grinder. Polishing was carried out at a grinder rotation speed of 3000 rpm for 1 minute.

Figure 2:
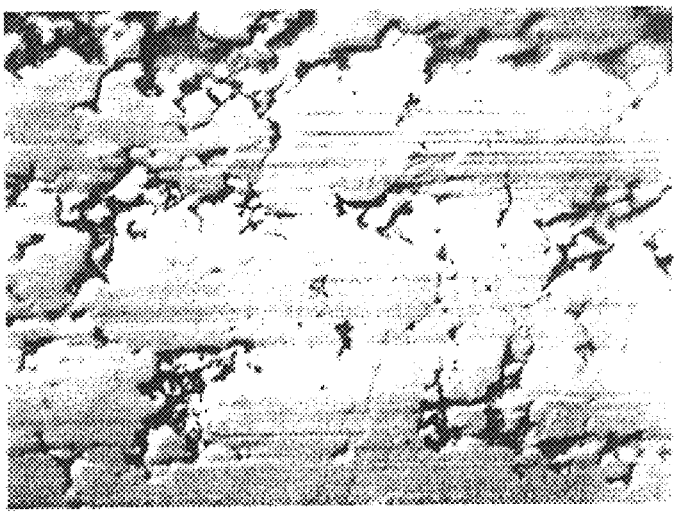
FIG. 2 is a differential interference microphotograph of the surface of a diamond thin film having been polished on the same polishing grinder referenced in the description of FIG. 1 at room temperature for 5 minutes.

The results are shown in FIGS. 1 and 2. FIGS. 1 and 2 are differential interference microphotographs with a magnification of ×400 and ×1000, respectively, of the diamond thin film after polishing.

In FIGS. 1 and 2, the black shadowy portions designate the unpolished portions and the white portions which may look grayish in the photograph designate the polished portions. As can be seen, the polishing rapidly progressed in just one short minute.

Although the polishing was carried out at room temperature, only a little wear took place in the grinder, and no cracks or fractures were observed. The $TiFe_2$ intermetallic compound polishing grinder exhibited a high polishing performance.

Example 2

Figure 3:
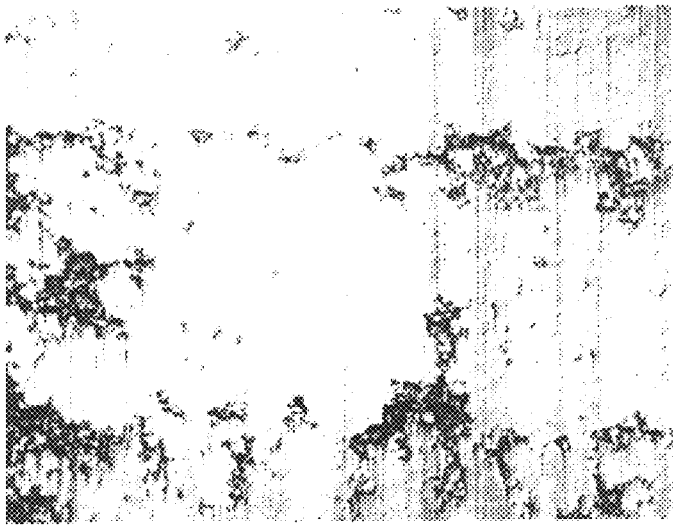
FIG. 3 is a differential interference microphotograph with a magnification of ×400 of the surface of a diamond thin film having been polished on a $TiFe_2$ intermetallic compound polishing grinder of example 2 at room temperature for 1 minute.
Figure 4:
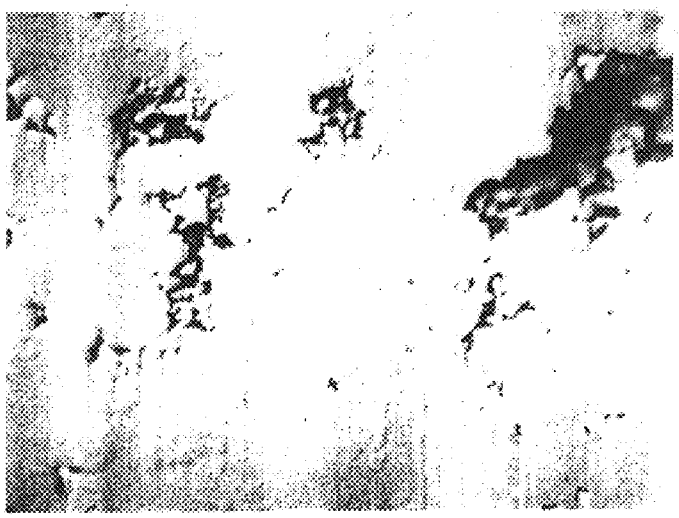
FIG. 4 is a differential interference microphotograph with a magnification of ×1000 of the surface of a diamond thin film having been polished on the same polishing grinder and under the same conditions as referenced in the description of FIG. 3.

A TiCo intermetallic compound polishing grinder was produced under the foregoing conditions, and the foregoing diamond thin film was polished at room temperature using the above grinder. Polishing was carried out at a grinder rotation speed of 3000 rpm for 1 minute. The results are shown in FIGS. 3 and 4. FIGS. 3 and 4 are differential interference microphotographs with a magnification of ×400 and ×1000, respectively, of the diamond thin film after polishing.

In FIGS. 3 and 4, the black shadowy potions designate unpolished portions and white portions which may look grayish in the photograph designate the polished portions. As can be seen, the polishing rapidly progressed in just one short minute, just as in the above example. Although the polishing was carried out at room temperature as in the above example, only a little wear took place in the grinder, and no fractures or cracks were observed. The TiCo intermetallic compound polishing grinder exhibited a high polishing performance.

Example 3

A TiNi intermetallic compound polishing grinder was produced under the foregoing conditions, and the foregoing diamond thin film was polished at room temperature using the above grinder. Two types of polishing were carried out at a grinder rotation speed of 3000 rpm for 1 minute and 5 minutes, respectively.

Figure 5:
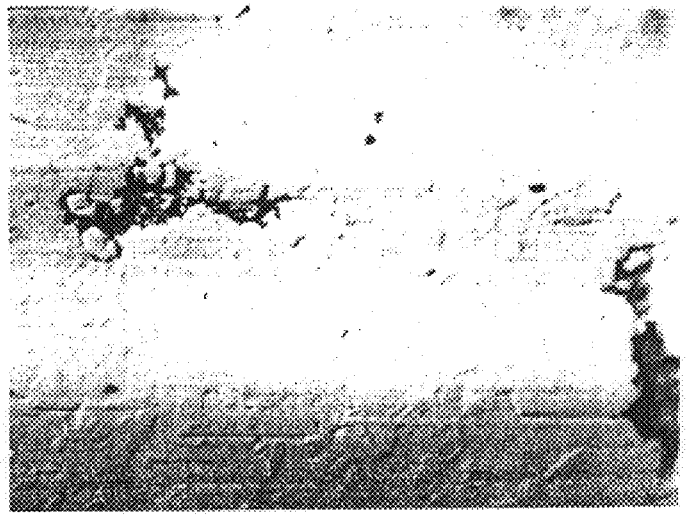
FIG. 5 is differential interference microphotograph with a magnification of ×400 of the surface of diamond thin film having been polished on a TiCo intermetallic compound polishing grinder of example 3 at room temperature for 1 minute.
Figure 6:
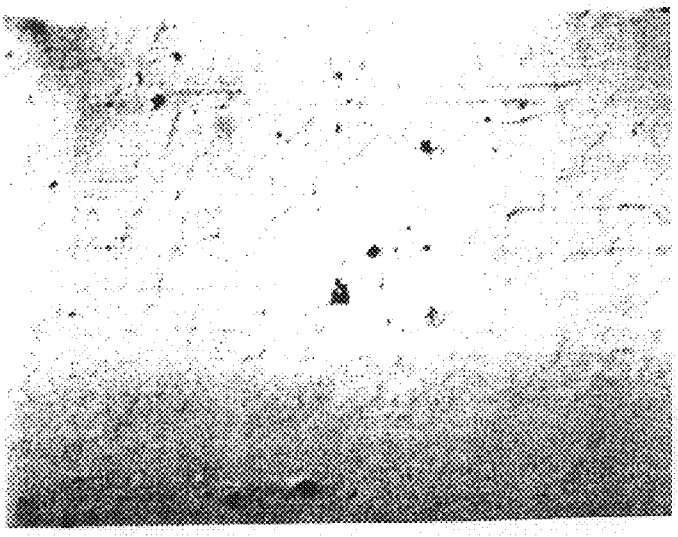
FIG. 6 is a differential interference microphotograph with a magnification of ×1000 of the surface of a diamond thin film having been polished on the same polishing grinder and under the same conditions as referenced in the description of FIG. 5.

The results are shown in FIGS. 5 and 6. FIGS. 5 and 6 are differential interference microphotographs with a magnification of ×1000 of the diamond thin film after the 1-minute polishing and the 5-minute polishing, respectively. The optical microphotograph with a magnification of ×1000 of the unpolished diamond thin film shows the same uneven surface as in FIG. 11 as will be described below.

In FIG. 5, the black shadowy portions designate unpolished portions and the white portions which may appear grayish in the photograph designate the polished portions. A step along the crystal grains is hardly observed in the figure. This indicates that polishing rapidly progressed in just one short minute.

FIG. 6 shows the diamond thin film after 5-minutes of polishing. As can be seen, polishing further progressed and almost all of the unpolished portions disappeared.

Although the polishing was carried out at room temperature, only a little wear tool place in the grinder, in addition, no fractures or cracks were observed. The TiNi intermetallic compound polishing grinder exhibited an extremely high polishing performance.

Example 4

A $TiMn_2$ intermetallic compound polishing grinder was produced under the foregoing conditions, and the foregoing diamond thin film was polishing at room temperature using the above grinder. Polishing was carried out at a grinder rotation speed of 3000 rpm for 1 minute. The results are shown in FIG. 7 which is a differential interference microphotograph with a magnification of ×400 of the diamond thin film after polishing.

Figure 7:
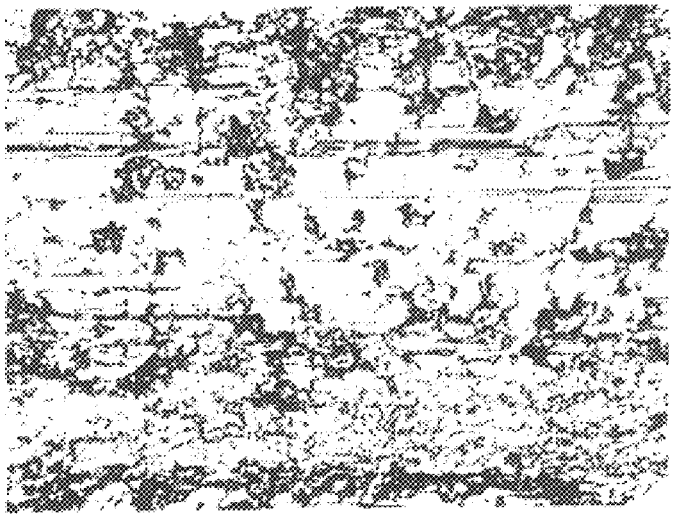
FIG. 7 is a differential interference microphotograph with a magnification of ×400 of the surface of a diamond thin film having been polished on a $TiMn_2$ intermetallic compound polishing grinder of example 4 at room temperature for 1 minute.

In FIG. 7, the black shadowy portions designate unpolished portions and the white linear portions which may appear grayish in the photograph designate the polished portions. As can be seen, polishing rapidly progressed in just one minute, just as in the above Example 3. Although polishing was carried out at room temperature, the $TiMn_2$ intermetallic compound polishing grinder exhibited a high polishing performance.

The $TiMn_2$ intermetallic compound polishing grinder, however, tends to be a little brittle compared with the other grinders of the present invention.

Example 5

A $TiCr_2$ intermetallic compound polishing grinder was produced under the foregoing conditions, and the foregoing diamond thin film was polishing at room temperature using the above grinder. Polishing was carried out at the grinder rotation speed of 3000 rpm for one minute. The results are shown in FIG. 8 which is a differential interference microphotograph with a magnification of ×1000 of the diamond thin film after polishing.

Figure 8:
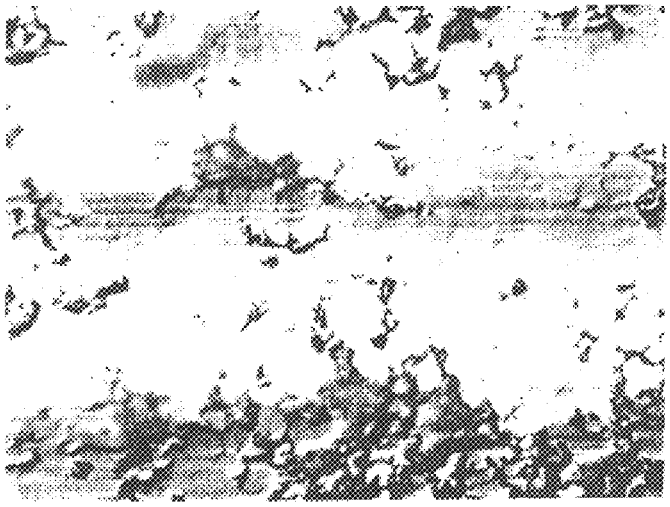
FIG. 8 is a differential interference microphotograph with a magnification of ×1000 of the surface of a diamond thin film having been polished on a $TiCr_2$ intermetallic compound polishing grinder of example 5 at room temperature for 1 minute.

In FIG. 8, the black shadowy portions designate unpolished portions and the white portions which may appear grayish in the photograph designate the polished portions. As can be seen, polishing rapidly progressed in just one minute, just as in the above Example 3. Although the polishing was carried out at room temperature, the $TiCr_2$ intermetallic compound polishing grinder exhibited a high polishing performance.

Example 6

A TiAl intermetallic compound polishing grinder was produced under the foregoing conditions, and the foregoing diamond thin film was polishing at room temperature using the above grinder. Two types of polishing were carried out at a grinder rotation speed of 500 rpm and 3000 rpm for five minutes, respectively.

Figure 9:
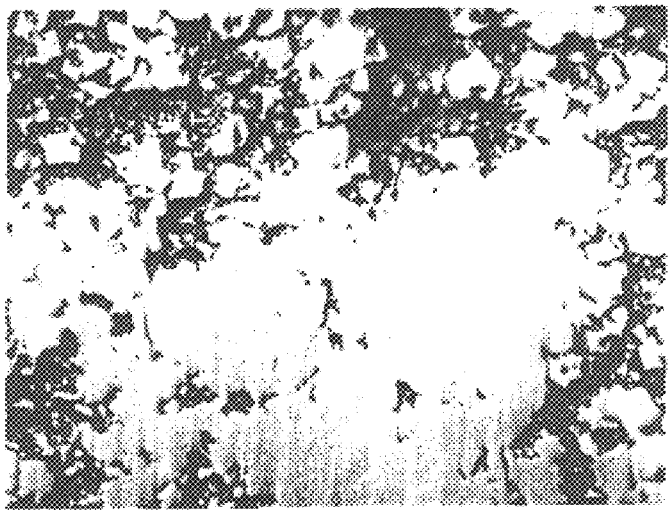
FIG. 9 is a differential interference microphotograph with a magnification of ×1000 of the surface of a diamond thin film having been polished on a TiAl intermetallic compound polishing grinder of example 6 at a rotation speed of 500 rpm at room temperature.
Figure 10:
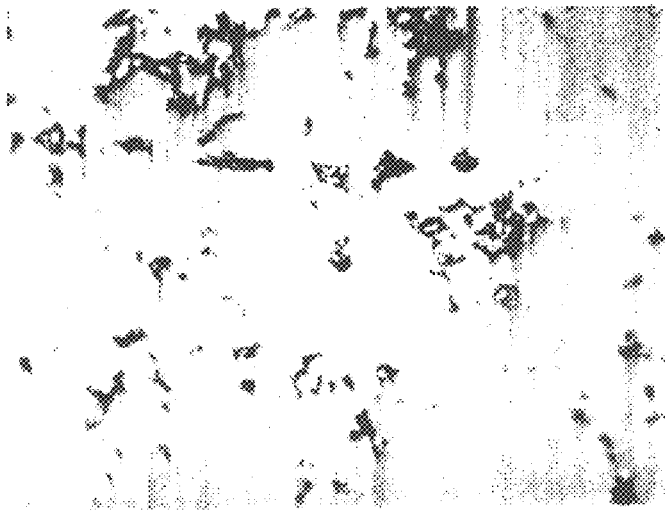
FIG. 10 is a differential interference microphotograph with a magnification of ×1000 of the surface of a diamond thin film having been polished on the same polishing grinder and under the same conditions as referenced in the description of FIG. 9 except for at a rotation speed of 3000 rpm.

The results are shown in FIGS. 9 and 10 which are differential interference microphotograph with a magnification of ×1000 of the diamond thin film after polishing.

In FIGS. 9 and 10, the black shadowy portions designate unpolished portions and the white portions which may also appear grayish in the photograph designate polished portions. As can be seen, polishing rapidly progressed in five minutes. Although the polishing was carried out at room temperature, the TiAl intermetallic compound polishing grinder exhibited a high polishing performance.

After the polishing, the step at grain boundary was tested with a surface roughness tester. The result was 0.02 $\mu$m or smaller, which indicates the polished plane has an excellent flatness.

Recently, the use of a diamond thin film surface elastic wave device has been examined in which arrayed electrodes are arranged on a ZnO thin film or the like deposited on the surface of the diamond thin film. The high sound velocity of the diamond thin film was used as a radio-frequency band filter or an optical communication timing clock in Ghz band communication. In a diamond thin film having been subjected to polishing according to the prior art, however, the step on the machined surface of the diamond thin film was 0.02–0.04 $\mu$m, and such a large step on the surface of the diamond thin film contributed to a variation in the distance between the arrayed electrodes, or to the deterioration and variation in the performance of the surface elastic wave device since the large step induced instability of performance of the piezoelectric thin film.

On the other hand, in the diamond thin film subjected to polishing with the grinder of the present invention, the step at the grain boundary is extremely small as described above. Accordingly, the diamond thin film according to the present invention was very effectively used as a sliding material under a heavy load or as a surface acoustic wave device.

Example 7

The foregoing diamond thin film was polished using the foregoing TiAl intermetallic compound polishing grinder at a grinder rotation speed of 400 rpm at room temperature. The states of the unpolished film and polished film at different polishing stages were observed. In particular, five stages were observed at 4, 8, 12, 16, 20 minutes after the start of the polishing. The pushing load was increased little by little within the range of 1–5 kgf. The results are shown in FIGS. 11–16 which are optical microphotographs having a magnification of ×1000.

Figure 11:
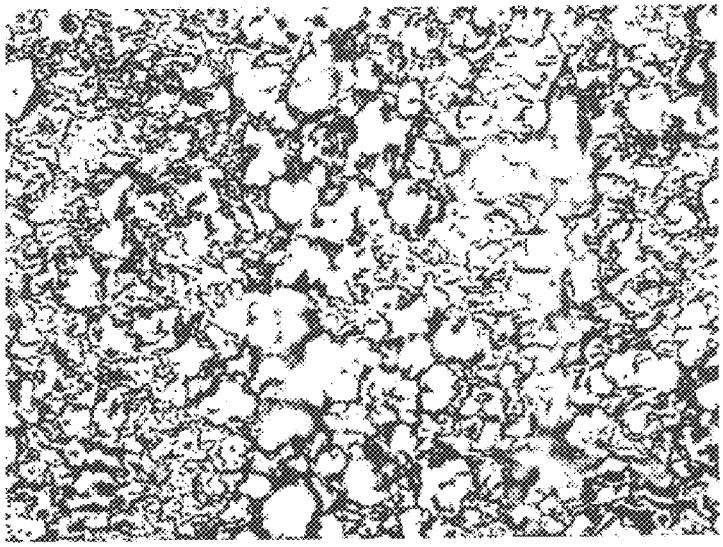
FIG. 11 is an optical microphotograph of the unpolished surface of the diamond thin film shown in example 7 as a reference.
Figure 12:
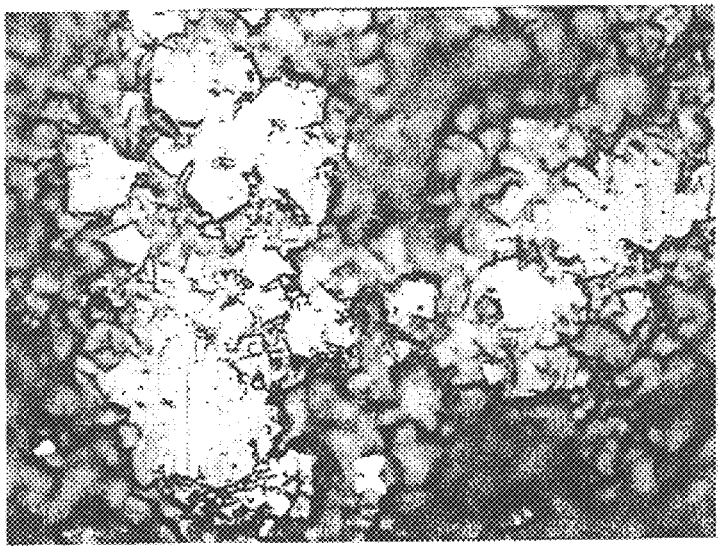
FIG. 12 is an optical microphotograph (with a magnification of ×1000) of the surface of a diamond thin film having been polished on a TiAl intermetallic compound polishing grinder of example 7 at a rotation speed of 400 rpm at room temperature for 4 minutes.
Figure 13:
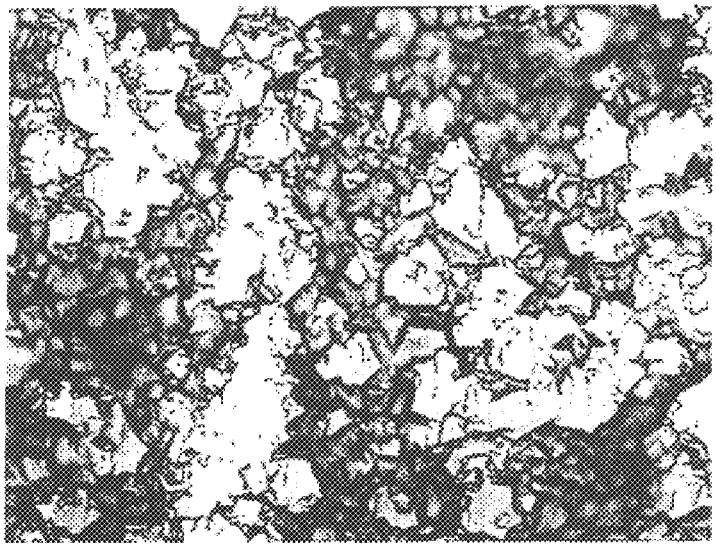
FIG. 13 is an optical microphotograph (with a magnification of ×1000) of the surface of a diamond thin film having been polished on the same polishing grinder and under the same conditions as referenced in the description of FIG. 12 except for at a polishing time of 8 minutes.

FIG. 11 shows the surface of the unpolished diamond thin film. As can be seen, fine crystal grains aggregate. In FIGS. 12 and 13, it is seen that the tips of the convex portions of the diamond crystal are gradually flattened (grayish portions) with the progress of the polishing and they are coming to connect with each other.

Figure 14:
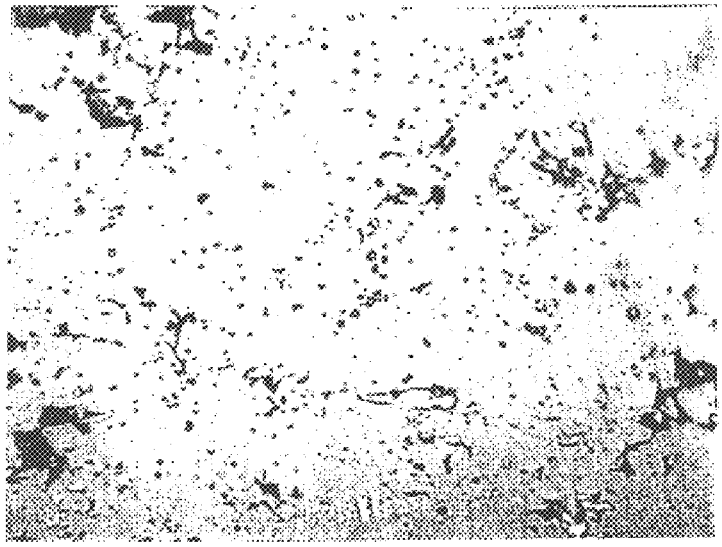
FIG. 14 is an optical microphotograph (with a magnification of ×1000) of the surface of a diamond thin film having been polished on the same polishing grinder and under the same conditions as referenced in the description of FIG. 13 except for at a polishing time of 12 minutes.
Figure 15:
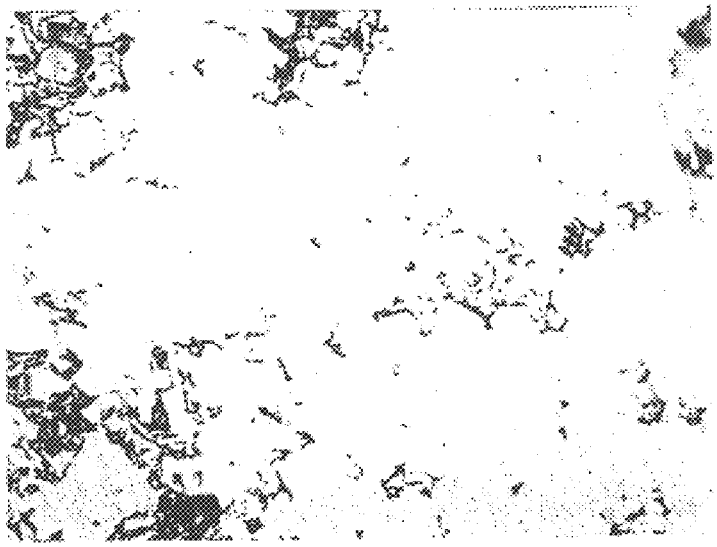
FIG. 15 is an optical microphotograph (with a magnification of ×1000) of the surface of a diamond thin film having been polished on the same polishing grinder and under the same conditions as referenced in the description of FIG. 14 except for at a polishing time of 16 minutes.
Figure 16:
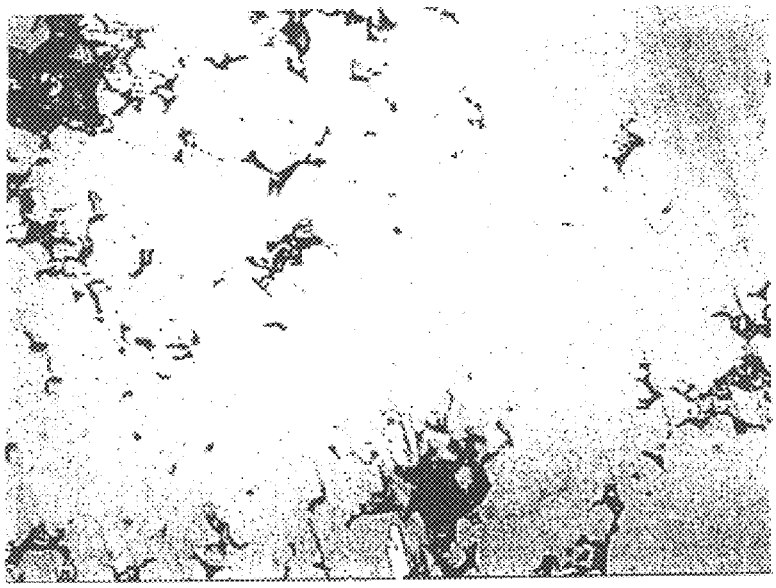
FIG. 16 is an optical microphotograph (with a magnification of ×1000) of the surface of a diamond thin film having been polished on the same polishing grinder and under the same conditions as referenced in the description of FIG. 15 except for at a polishing time of 20 minutes.

In FIGS. 14–16, the surface of the diamond thin film is flattened, and the unpolished portions (black shadowy portions) are gradually being decreased. As for the TiAl intermetallic compound polishing grinder, its good flatness and smoothness were maintained even after the polishing operation, and only a little wear on the tool took place during the polishing process.

Thus it was confirmed that the diamond thin film can be effectively polished with the intermetallic compound polishing grinder of the present invention.

Example 8

A TiCu intermetallic compound polishing grinder was produced, and the foregoing diamond thin film was polishing at room temperature using the above grinder. Polishing was carried out at the grinder rotation speed of 3000 rpm for one minute.

Although this intermetallic compound polishing grinder is a little inferior to the other grinders of the present invention in polishing performance (not shown in the figures), it is found that the diamond thin film can be polished with this polishing grinder at room temperature.

Example 9

A composite intermetallic compound polishing grinder consisting of TiAl, $TiFe_2$, $TiCr_2$ and TiNi was produced, and the foregoing diamond thin film was polished at a grinder rotation speed of 3000 rpm for one minute.

This grinder exhibited the same degree of polishing performance as the TiAl intermetallic compound polishing grinder (not shown in the figures). It was confirmed that the composite intermetallic compound polishing grinder having the above composition also has a polishing performance equivalent to that of the TiAl intermetallic compound polishing grinding.

Comparative Example 1

For comparison, the diamond thin film was polished at room temperature with a Ti—6 wt % Al—4 wt % V alloy having a very high strength and toughness. In this case, the Ti—6 wt % Al—4 wt % V alloy was produced by a melting method. Polishing was carried out at a grinder rotation speed of 3000 rpm for five minutes.

The result shows that the above Ti—6 wt % Al—4 wt % V alloy was adhered on the surface of the diamond thin film, became rapidly worn, and did not polish the diamond thin film at all. Thus it was confirmed that the alloy composition could not polish diamond.

Example 10

The mechanically alloyed TiAl powder was used as material powder and the same amount of Ti powder and Al powder were filled into a mold to be preformed.

The preformed alloy was subjected to hot press sintering (HP treatment) under the conditions of 1000–1300° C., 500 $Kgf/cm^2$ to provide a sintered TiAl intermetallic compound disk 30 mm in diameter and 5 mm in thickness. The relative density of the TiAl intermetallic compound disk was 99.9 percent.

Figure 17:
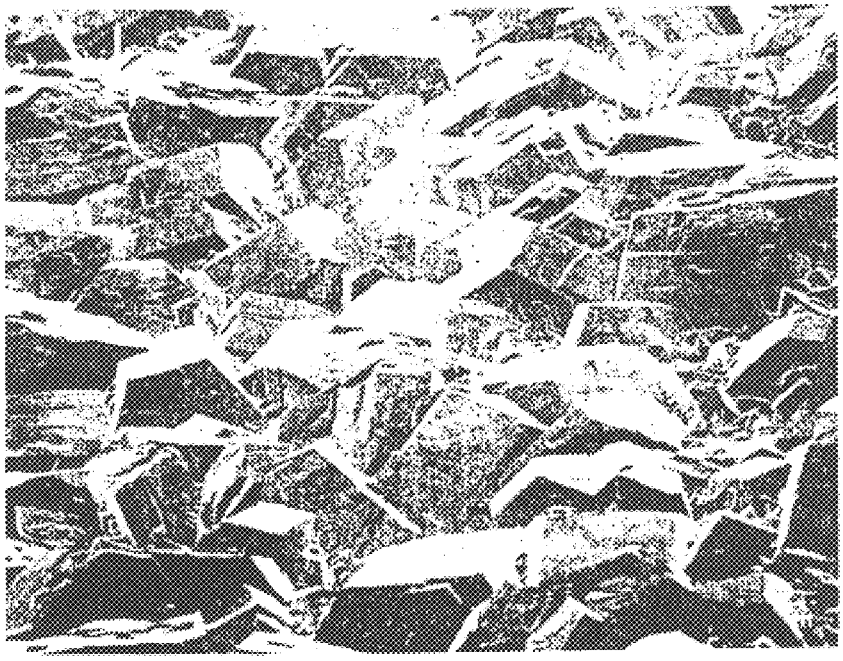
FIG. 17 is an electron microphotograph of the surface of a free-standing diamond film before polishing as described in example 10.

This disk was finished to a shape of a grinder; the grinder was fixed to a lathe; and many free-standing diamond films were polished using the grinder under the conditions below. An electron microphotograph of the surface of the free-standing diamond film before polishing is shown in FIG. 17.

Subject of Polishing

A free-standing diamond film of 500 $\mu$m was formed on a substrate by microwave plasma CVD, and the free-standing diamond film was obtained by removing the substrate.

Polishing Conditions

Rotation speed of lathe: 1600 rpm;

Heating means: the portion subjected to polishing was heated to 100–800° C. with a gas burner;

Pushing load: 5 kgf–10 kgf;

Duration: 1–10 minutes.

Figure 18:
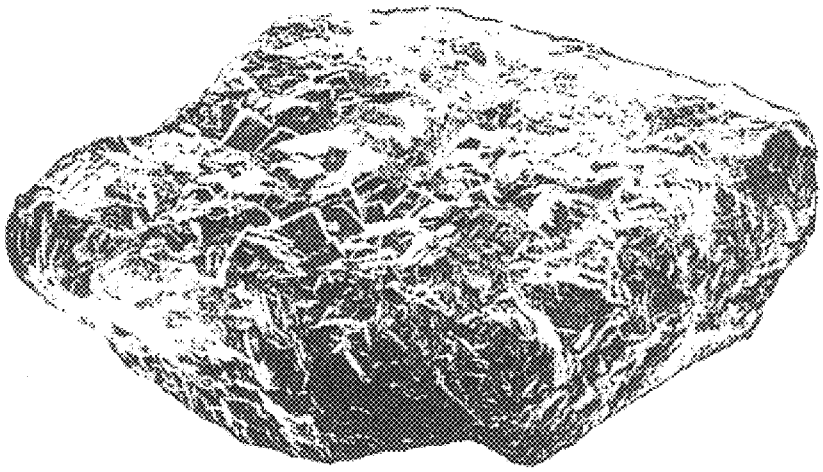
FIG. 18 is an electron microphotograph of the surface of a free-standing diamond film after polishing on heating on a TiAl intermetallic compound polishing grinder of example 10.
Figure 19:
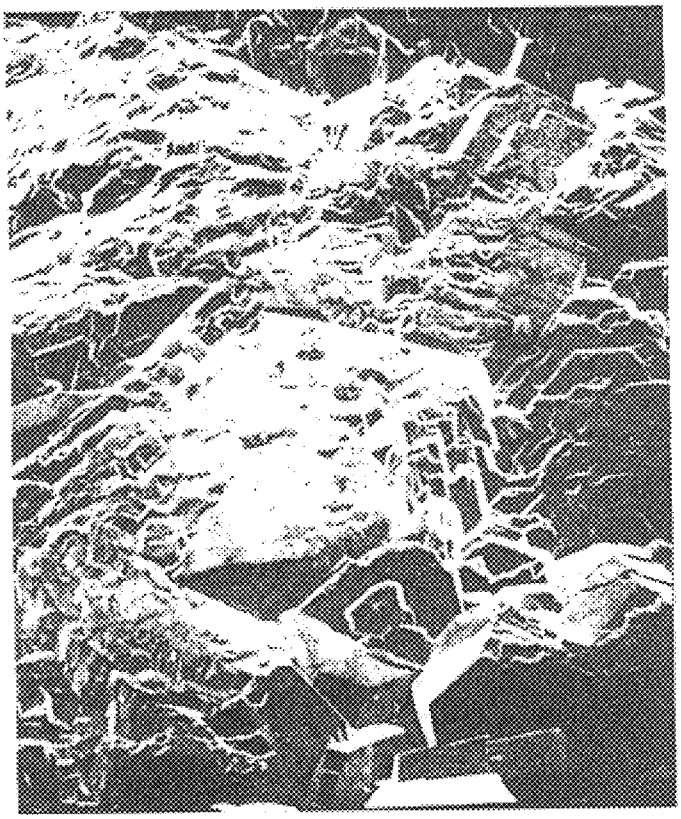
FIG. 19 is an enlarged electron microphotograph of the surface of the same free-standing diamond film as referenced in the description of FIG. 18.

An electron microphotograph of the surface of the free-standing diamond film after polishing is shown in FIGS. 18 and 19. FIG. 19 is a partially enlarged view (photograph) of FIG. 18. In this example, heating temperature was 350±50° C., pushing pressure was 10 kgf, and polishing duration was 3 minutes.

In the electron microphotograph of the surface of the free-standing diamond film before polishing shown in FIG. 17, an intense step of the diamond crystal grains (20–100 μm in grain size) is observed. On the other hand, as can be seen from the electron microphotograph of the same after polishing shown in FIG. 18, the step is decreased and the surface looks roundish.

Thus it was confirmed that the free-standing diamond film can be polished in an extremely short time. Neither cracks nor fractures took place in the free-standing diamond film and degradation in quality was not observed.

The grinder of the TiAl intermetallic compound disk was checked after polishing. After 10 times of polishing, almost no wear took place in the grinder and it was reusable.

The same polishing as above was carried out at different temperatures including 200° C., 300° C., 400° C., 500° C., 600° C., 700° C. and 800° C. while changing the pushing pressure, the rotation speed of the lathe, and the polishing duration.

As a result, it was found that, since the grinder toughness of the TiAl intermetallic compound disk is degraded at temperatures lower than 100° C. and cracks take place in the grinder, the polishing performance of the grinder is poor for a thick diamond film of a large grain diameter at such temperatures.

It was also found that temperatures over 800° C. are likely to cause cracks and fractures in the free-standing diamond film and therefore is not preferable. The preferable heating temperature is in the range of 300–500° C.

It was confirmed that a temperature in the range of 300–500° C. is extremely suitable to provide conditions under which neither cracks nor fractures takes place in the TiAl intermetallic compound disk grinder. In addition, the strength and hardness of the same can be kept at an extremely high level; a stable high quality polishing can be carried out rapidly; and only a little wear takes place in the grinder.

At points where the free-standing diamond film comes into contact with the grinder, the temperature is considerably raised by the frictional heat and the heat applied from outside sources. It is presumed that, under such conditions, chemical polishing occurs due to, for example, the formation of TiC, TiAlC, TiAlCN, etc., which allows the polishing of diamond to effectively progress.

It was found that in the above temperature range, the diamond is not damaged. Therefore, the range provides excellent processing conditions for both the diamond and the grinder.

As described above, heating during polishing of diamond is very important, particularly when the thickness of the diamond is several tens of microns or more.

Generally, in a diamond thin film with a thickness of several tens of microns or larger, crystal grains with different crystallographic orientations whose grain size is several microns to several tens of microns are formed on the surface of the thin film during thin film growth. This results in an intense step being formed among the crystal grains. With respect to the above referenced free-standing diamond film of 500 μm thickness, the crystal step of the surface of the film reached about 20–100 μm.

When polishing such a diamond film, non-uniform tensile strain takes place in the polishing surface of the grinder, which provides in the grinder origin points for brittle mode fracture.

In such a case, when carrying out polishing at room temperature, an intense wear and infinitesimal cracks take place in the grinder due to the intense step described above. The cracks expand with the progress of polishing and can cause a fracture during a polishing process. The application of heat to the portion subjected to polishing is characterized in that it can blunt the origins of such fractures.

In this example, although a gas burner was used as a heating means for heating the portion subjected to polishing, it is natural that other heating means can also be used. Direct current heating or radio frequency inductive heating methods applied to the grinder are effective.

As described above, according to the present invention, polishing is carried out while allowing the grinder to come into contact with the diamond film. Naturally, frictional heat is generated at their contact portions. Thus, the heating operation takes into account both heat from outside sources and frictional heat.

When the pushing pressure and the grinder rotation speed are high, excessive force is added to both grinder and diamond film. This can cause damage to the diamond film and the grinder. The above conditions, however, may be optionally changed according to each individual situation and are not fixed restrictive requirements.

The polishing duration can also be changed; however, when using the polishing grinder of the present invention, the polishing duration is not a problem since polishing can be carried out efficiently in a short time.

Friction/Wearing Test

A friction/wearing test was carried out for the polished diamond obtained in the above example 10 and a polycrystalline diamond thin film of 500 μm thickness as a comparative material. The polycrystalline diamond thin film was formed under the same conditions as the above diamond and was subjected to the same polishing process. Its substrate was not removed, and it was subjected to polishing utilizing a currently used prior art polishing grinder.

The pin/on/disk type of fracture/fracture test was carried out using stick single crystal diamond pins each having different radius of pin tip (radius of curvature R=0.025 mm, 0.25 mm) in atmospheric under no-lubrication conditions.

According to the measurements before the above test, the average step in the polished plane at grain boundaries of the diamond having been subjected to polishing process as a comparative material was 0.12 μm, and the average step in the polished plane at grain boundaries of the diamond having been subjected to polishing process obtained in example 10 was 0.03 μm.

For each of the above diamonds having been subjected to a polishing process, the load and the average coefficient of frictions were comparatively measured using stable values in the vicinity of sliding distance of 500 m. The measurements of both showed values as low as 0.02–0.03.

However, in the comparative material, especially when its pin radius of curvature R=0.025 mm, the maximum roughness of machined surface after fracture rapidly increased with the increase in the load. When the load was 1.96 N, the surface roughness Ry was over 1 μm.

From the observation of the worn surface of the comparative material using a laser microscope, it was confirmed that there existed worn parts of the pin on both sides of the fracture scores. And the fracture rate of the machined surface rapidly increased with the increase in the load (increase in maximum Herzian contact pressure).

On the other hand, in the diamond having been subjected to polishing process obtained in example 10, when pin radius of curvature R=0.025 mm and the load was 1.96 N, the surface roughness Ry remained the same as the initial one and the fracture rate was as small as $4.0\times10^{-2}$ $mm^3/mm$ or less.

The above results indicate that, under maximum Hertzian contact pressure, cracks are partially propagated at the uneven portion of the machined surface, and thereby the wear is increased. It is apparent that the step on the polished plane at grain boundaries of the diamond having been subjected to polishing process strongly affects the results of the fracture/fracture test.

As described above, according to the present invention, a diamond having been subjected to polishing process whose step on the polished plane is 0.1 $\mu$m or smaller can be materialized. Such a diamond having been subjected to a polishing process is characterized by a low fracture rate, a highly reliable fracture behavior lasting a long period of time and a stable low fracture property even under severe conditions. Accordingly, it is further characterized by a high utility value in the fields of engineering and medicine, for example, ultra-precision mechanical parts, artificial joints, dental parts, etc.

Comparative Example 2

Polishing was attempted using a grinder of cemented carbide (WC+16% Co) and the same free-standing diamond film as in the above example under the same conditions as the above example. However, the grinder of cemented carbide could not polish the free-standing diamond film at all at heating temperatures between 100–800° C. On the contrary, the grinder was ground by the free-standing diamond film.

Thus, polishing was further attempted at a raised temperature of 1000° C. At the beginning, the grinder partially reacted with the diamond and the free-standing diamond film was polished; however, the polishing grinder was gradually softened and polishing could not be continued.

Comparative Example 3

Polishing was carried out using the periphery of a SUS304 stainless steel disk grinder of $\phi$204 mm in outside diameter ×5 mm in thickness and a similar free-standing diamond film on a surface grinding machine at room temperature. The disk edge of the periphery of the grinder was formed to be 0.1 mm thick, and the grinder rotation speed was 5000 rpm.

Polishing was carried out under the above noted conditions for about 20 seconds while changing the depth of cut amount in the Z direction. When the maximum load was 250 $kg/cm^2$ or less (reaction force in the Z direction: 3 kgf), the grinder was ground, but the free-standing diamond film was not polished.

When the maximum load was set at 540 $kg/cm^2$ (reaction force in the Z direction: 8 kgf), although the free-standing diamond film was polished while giving off sparks, the grinder components firmly adhered on the polished portion and the deposit was hard to remove even with a strong acid. In both of the above cases, cracks or fractures took place in the free-standing diamond film.

The polishing was carried out while heating the grinder to about 1000° C. so as to improve the polishing performance. The polishing of the free-standing diamond film was a little facilitated; however, the adhesion of the grinder components was further increased and the free-standing diamond film was fractured in all the polishing tests carried out with heat.

Although a constant pressure polishing test was also carried out using the edge surface of the above disk grinder, the results were the same as above.

Since the thermal expansion rate of the above grinder is large, the more heat applied to it, the less it becomes stable due to a change in polished contact position with temperature during polishing processing. Accordingly, an excessive polishing pressure has to be added, which will cause fracture during polishing of the diamond film.

In addition, due to thermal shock to the diamond, cracks will take place in the grinder, which can lead to the fracture of the grinder, and the grinder can never be used for polishing. When using other grinders of, for example, cemented carbide, or hard or soft metal, the results were almost the same.

It is apparent from the above that the grinder of this comparative example is inferior to the grinders of the present invention in polishing performance. Further, the present inventor could not find a material among the existing materials which has the polishing properties equivalent to those of the grinder of the present invention.

Comparative Example 4

Polishing was carried out utilizing the same free-standing diamond film as in Example 10 under the same conditions except that heat from an outside source was not applied, in other words, polishing was carried out at room temperature.

As a result, cracks and fractures took place in the TiAl intermetallic compound grinder, moreover, the TiAl intermetallic compound grinder was polished by the rough free-standing diamond film.

From the above results, it was found that, when the crystal grain size was 20–100 $\mu$m, especially in a free-standing diamond film of several tens of $\mu$m or larger, a step of several $\mu$m–several tens of $\mu$m was created among the crystal grains with different crystallographic orientations as the film grows, and this step made the polishing at room temperature difficult.

Thus, it was found that an application of heat from an outside source is effective when the conditions of the crystallographic plane, that is, the crystal grains of the diamond, are coarsened and an intense step is created on the surface of the diamond film.

Example 11

Natural diamond was polished using a TiAl intermetallic compound grinder.

Natural Ib type rhombic dodecahedron diamond single crystal was fixed with a fixture, and polishing was carried out for the (111) plane at room temperature after specifying the plane direction.

Figure 20:
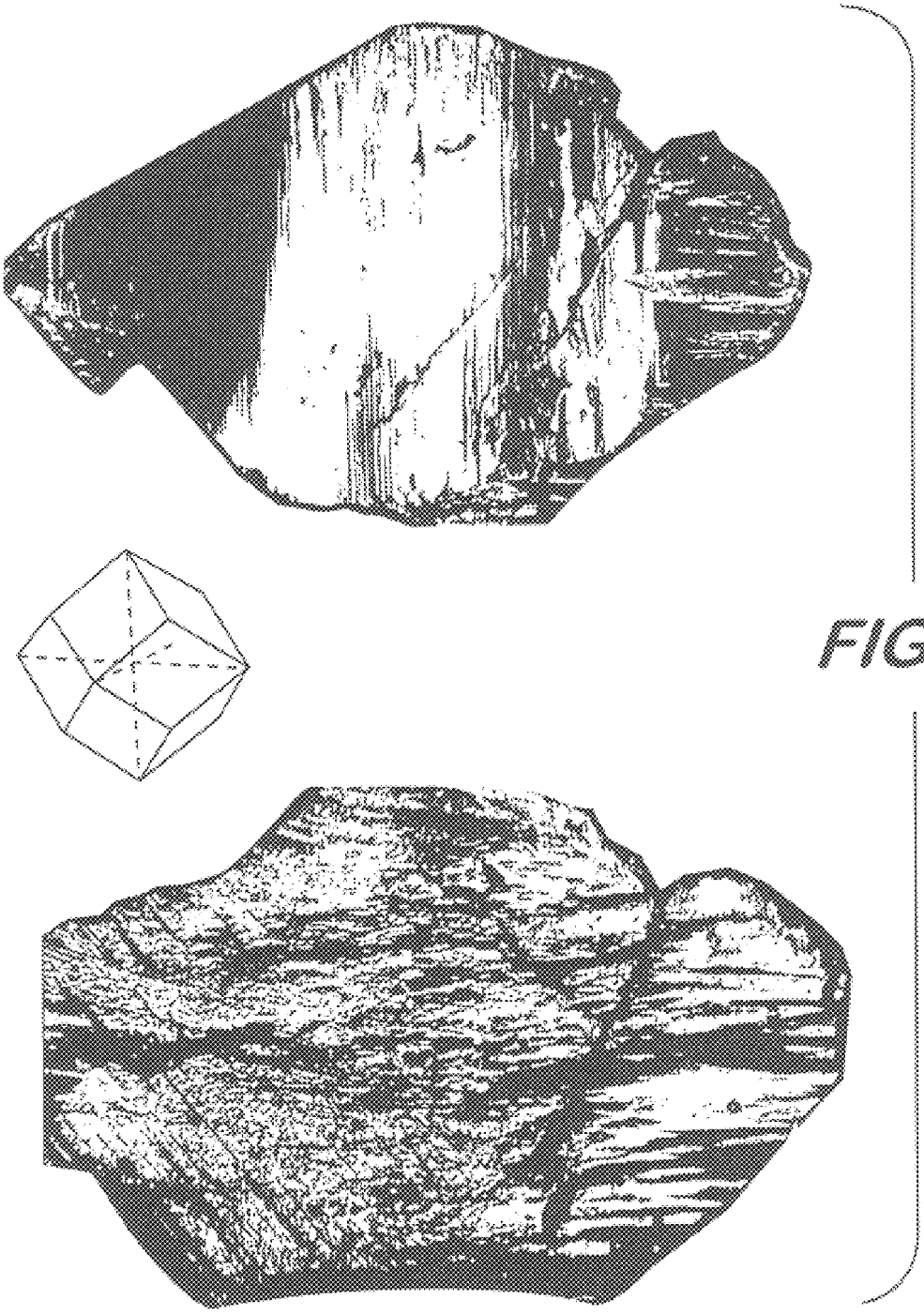
FIG. 20 is a pair of microphotographs of the surface of a natural (single crystal) diamond after (upper microphotograph) and before (lower microphotograph) polishing on a TiAl intermetallic compound polishing grinder.

The result of the polishing at the grinder rotation speed of 2250 rpm for three minutes is shown in the upper microphotograph on FIG. 20. For comparison, the (111) plane of the same diamond single crystal before polishing is shown in the lower microphotograph of FIG. 20. They are optical microphotographs before and after polishing, respectively.

As can be seen from FIGS. 20A and 20B, the (111) plane of diamond single crystal, which is extremely hard to polish using prior art apparatus, was satisfactorily polished in just three short minutes.

Example 12

A sintered diamond compact sintered under ultrahigh pressure synthesis was polished using the same TiAl intermetallic compound grinder, and Co and WC were used as binders. Polishing was carried out at the grinder rotation speed of 2250 rpm at room temperature for 30 minutes using a milling machine as a processing apparatus.

Figure 21:
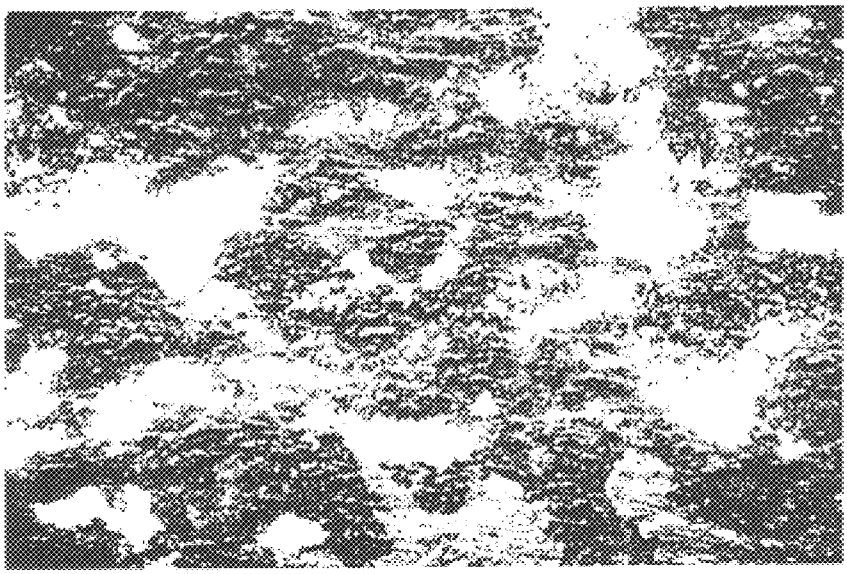
FIG. 21 is an electron microphotograph of the surface of a sintered diamond compact after polishing on a TiAl intermetallic compound polishing grinder.
Figure 22:
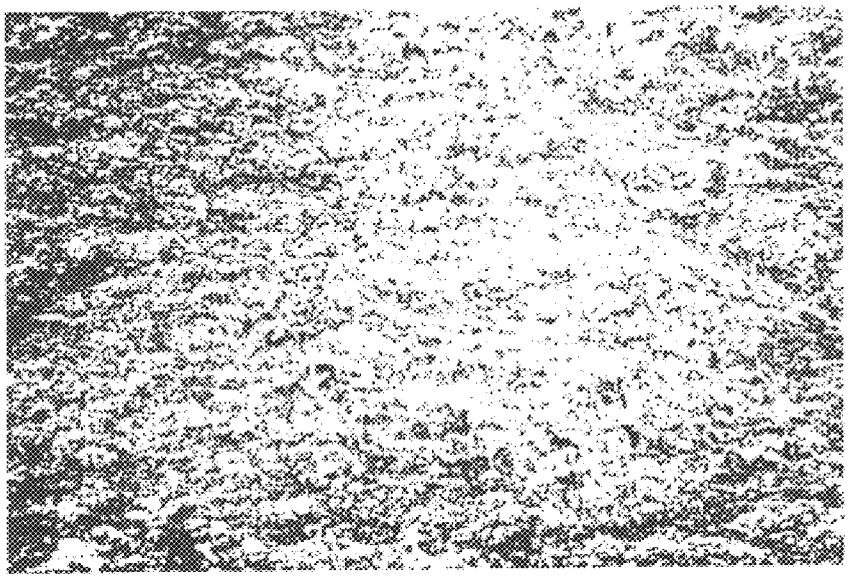
FIG. 22 is an electron microphotograph of the surface of a sintered diamond compact illustrated in FIG. 21 before polishing.

The results are shown in FIG. 21. For comparison, the sintered diamond compact before polishing is shown in FIG. 22. Both of the figures are electron microphotographs with a magnification of ×1000.

In FIG. 21, the black portions designate diamond crystal grains and the grayish and white portions the binder. As can be seen, polishing satisfactorily progressed both at the diamond crystal grain portions and at the binder portions in just 30 minutes.

The examination of the surface roughness after polishing revealed that there existed almost no step at diamond grain/binder boundaries and an excellent polished plane having a surface roughness of 0.5 $\mu$m or less was provided.

Although Co and WC were used as a binder for the sintered diamond compact in this example, when using the other binders such as TiC, the same results were obtained. Further, although a TiAl intermetallic compound grinder was used in this example, when using the other grinders of the present invention, the same results were obtained.

Example 13

An intermetallic-compound/diamond composite grinder was produced by mixing diamond abrasive with the intermetallic compound grinder of the present invention, and polishing was carried out with this grinder on a gas phase synthesized diamond thin film and a sintered diamond compact.

An intermetallic-compound/diamond composite grinder was produced by mixing 9.1 wt percent of #325/400 mesh diamond abrasive with the TiAl intermetallic compound and sintering the mixture integrally with the periphery of a ϕ32 mm grinder. As a processing apparatus, a ball milling machine was used, and polishing was carried out at a grinder rotation speed of 3000 rpm. For comparison, polishing was carried out in the same manner using a currently available metal bonded diamond wheel.

In terms of the efficiency of polishing, the intermetallic-compound/diamond composite grinder of the present invention was overwhelmingly excellent. In addition, damage to the diamond thin film and sintered diamond compact, such as cracks or fractures and chipping, was not observed at all.

On the other hand, the use of a currently available metal bonded diamond wheel caused cracks and fractures in both the diamond thin film and sintered diamond compact and also caused chipping in the grinder itself.

The remarkable effects of the intermetallic-compound/diamond composite grinder of the present invention were confirmed from this example.

Example 14

A Zr—Ni intermetallic compound ($Zr_7N_{10}$) grinder was produced using Zr instead of Ti under the same conditions as in the above example, and polishing was carried out at room temperature for both a gas phase synthesized diamond thin film and a sintered diamond compact sintered under ultrahigh pressure.

The shape of the grinder was ϕ30 mm. As a processing apparatus, a milling machine was used, and polishing was carried out at a grinder rotation speed of 3000 rpm for one minute.

Figure 23:
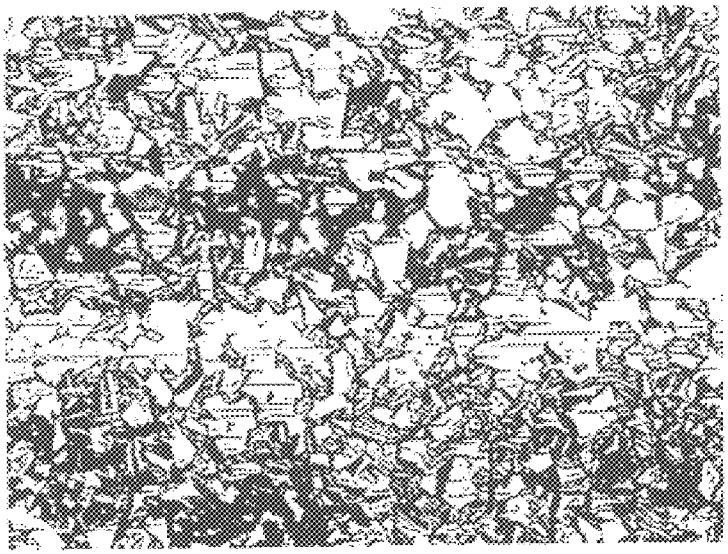
FIG. 23 is an optical microphotograph (with a magnification of ×625) of the surface of a gas phase synthesized diamond thin film after polishing on Zr—Ni intermetallic compound ($Zr_7Ni_{10}$) polishing grinder.

The results of polishing the gas phase synthesized diamond thin film are shown in FIG. 23 which is an optical microphotograph with a magnification of ×625 of the surface of the gas phase synthesized diamond thin film after polishing.

In the figure, the black portions designate the unpolished portions of the diamond crystal grains and the grayish and white portions the polished portions. In the same figure, almost no step along the crystal grains was observed. It is apparent that polishing of the diamond crystal portions progressed in just one minute. The polishing performance of this grinder was satisfactory just like the above intermetallic compound grinder, for example, of TiAl used in the examples of this invention.

Figure 24:
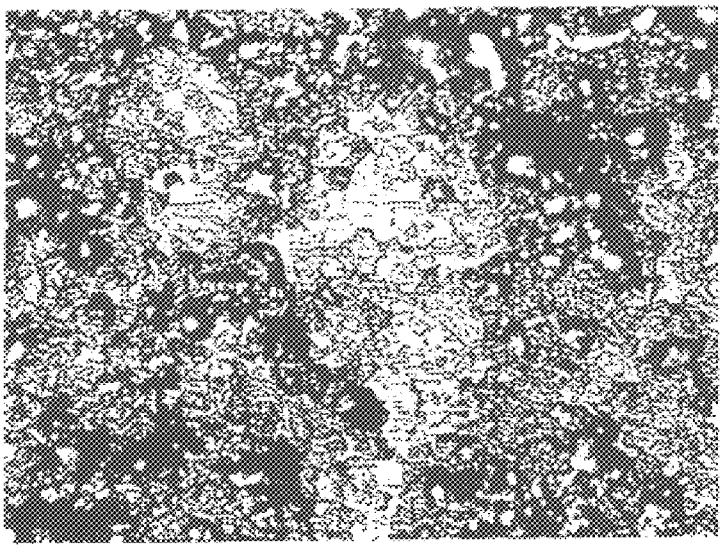
FIG. 24 in an optical microphotograph (with a magnification of ×625) of the surface of a sintered diamond compact after polishing on the same polishing grinder as referenced in the description of FIG. 23.

FIG. 24 is an optical microphotograph with a magnification of ×625 of the surface of the sintered diamond compact sintered under ultrahigh pressure after polishing. The black portions designate the unpolished portions of the diamond crystal grains and the grayish and white portions the polished portions.

Like the case of the gas phase synthesized diamond thin film, polishing progressed rapidly in just one minute. The polishing performance of this grinding was satisfactory just like the foregoing TiAl intermetallic compound grinders.

Example 15

An Nb—Co intermetallic compound ($Nb_6CO_7$) grinder was produced using Nb instead of Zr under the same conditions as in the above example, and polishing was carried out at room temperature for both a gas phase synthesized diamond thin film and a sintered diamond compact sintered under ultrahigh pressure.

The polishing conditions were just like Example 14: the shape of the grinder was ϕ30 mm, the grinder rotation speed was 3000 rpm on a milling machine, and the polishing duration was one minute.

Figure 25:
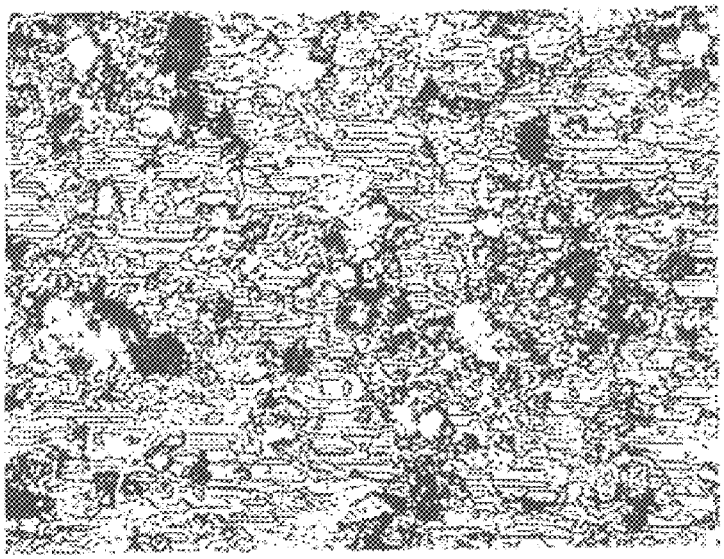
FIG. 25 is an optical microphotograph (with a magnification of ×625) of the surface of a sintered diamond compact after polishing on a Nb—Co intermetallic compound ($Nb_6Co_7$) polishing grinder.

FIG. 25 is an optical microphotograph with a magnification of ×625 of the surface of the sintered diamond compact sintered under ultrahigh pressure after polishing. The black portions designate the unpolished portions of the diamond crystal grains and the grayish and white portions the polished portions.

As can be seen, polishing progressed rapidly in just one minute, like the foregoing cases. The polishing performance of this grinder was satisfactory just like the foregoing intermetallic compound grinders, for example, of TiAl used in the examples of this invention.

Although not shown in the figure, the polishing results were also excellent for the gas phase synthesized diamond thin film, like the case of Example 14. The polishing of the diamond film progressed in just one minute.

An Nb—Al intermetallic compound ($Nb_2Al$) grinder was also produced, and polishing was carried out at room temperature for both a gas phase synthesized diamond thin film and a sintered diamond compact sintered under ultrahigh pressure. The same results were obtained as in the case of the above Nb—Co intermetallic compound ($Nb_6CO_7$) grinder.

Example 16

An Ni—Nb intermetallic compound ($Ni_3Nb$) grinder was produced under the same conditions as in the above example, and polishing was carried out at room temperature for both a gas phase synthesized diamond thin film and a sintered diamond compact sintered under ultrahigh pressure.

The polishing conditions were just like Example 14: the shape of the grinder was ϕ30 mm, the grinder rotation speed was 3000 rpm on a milling machine, and the polishing duration was one minute.

Figure 26:
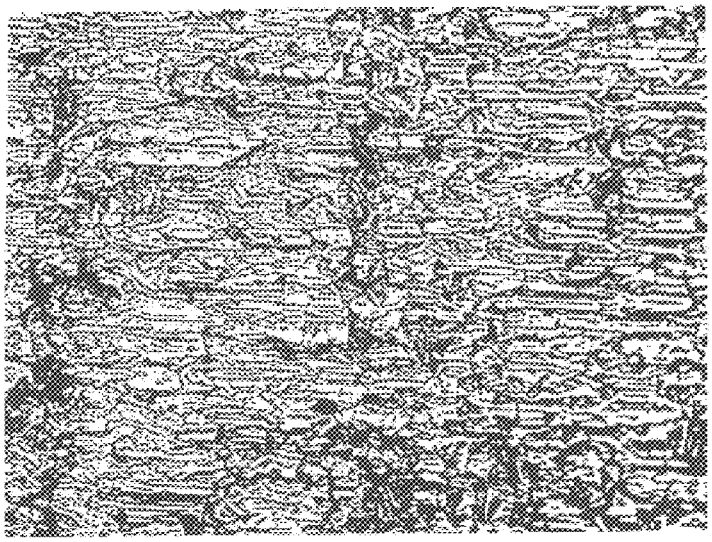
FIG. 26 is an optical microphotograph (with a magnification of ×625) of the surface of a gas synthesized diamond thin film after polishing on a Ni—Nb intermetallic compound ($Ni_3Nb$) polishing grinder.

FIG. 26 is an optical microphotograph with a magnification of '625 of the surface of the gas phase synthesized diamond thin film after polishing. The black portions designate the unpolished portions of the diamond crystal grains and the grayish and white portions the polished portions.

As can be seen, polishing of the diamond grains progressed rapidly in just one minute, like the foregoing cases. The polishing performance of this grinder was satisfactory just like the foregoing intermetallic compound grinders, for example, of TiAl used in the examples of this invention.

The polishing results (not shown) were also excellent for the sintered diamond compact, like the case of the foregoing examples. The polishing of the sintered diamond compact satisfactorily progressed in just one minute.

Example 17

A Ti—Pt intermetallic compound ($Ti_3Pt$) grinder and a Ta—Ru intermetallic compound (TaRu) grinder were produced under the same conditions as in the above example, and polishing was carried out at room temperature for both a gas phase synthesized diamond thin film and a sintered diamond compact sintered under ultrahigh pressure.

The polishing conditions were just like Example 14: the shape of the grinder was ϕ30 mm, the grinder rotation speed was 3000 rpm on a milling machine, and the polishing duration was one minute.

The polishing performance of these grinders were satisfactory just like the foregoing intermetallic compound grinder, for example, of TiAl used in the examples of this invention.

Further, it was confirmed that when using the combination of an element of the platinum group, such as Rh, Pd, Os, Ir and Pt with an element selected from the group of Ti, V, Zr, Nb, Mo, Hf, Ta and W, the same results are obtained. The use of the grinder containing the element of the platinum group is effective particularly when the subject of polishing has to be kept away from the incorporation of impurities.

Example 18

A composite intermetallic compound grinder consisting of a Ti—Ni intermetallic compound (TiNi) and a Nb—Co intermetallic compound ($Nb_6CO_7$) was produced under the same conditions as in the above example, and polishing was carried out at room temperature for both a gas phase synthesized diamond thin film and a sintered diamond compact sintered under ultrahigh pressure.

The polishing conditions were as follows: the shape of the grinder was ϕ30 mm, the grinder rotation speed was 3000 rpm on a milling machine as a processing apparatus, and the polishing duration was one minute.

Figure 27:
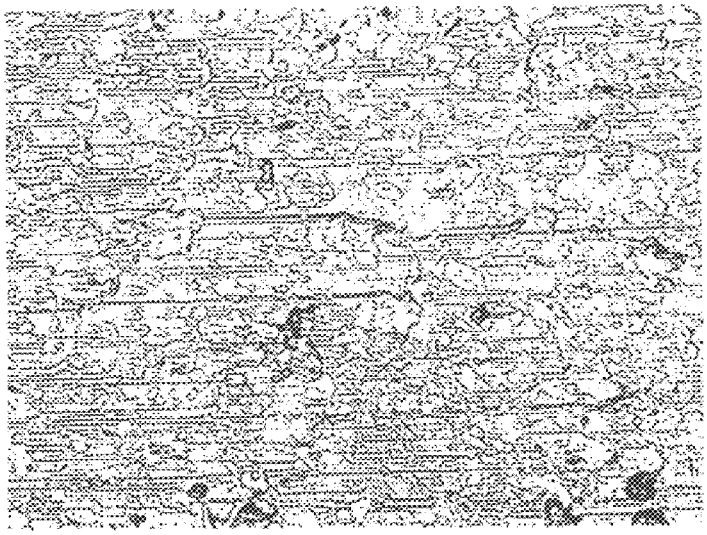
FIG. 27 is an optical microphotograph (with a magnification of ×625) of the surface of a sintered diamond compact after polishing on a composite intermetallic compound polishing grinder consisting of Ti—Ni intermetallic compound (TiNi) and Nb—Co intermetallic compound ($Nb_6Co_7$)

The results of polishing the sintered diamond compact are shown in FIG. 27 which is an optical microphotograph with a magnification of ×625 of the sintered diamond compact after polishing.

The black portions designate the unpolished portions and the grayish and white portions the polished portions. As can be seen, polishing progressed in just one minute. Further, it was confirmed that the falling off (black portions) of the diamond abrasive was remarkably small. The polishing performance of this grinder was satisfactory just like the foregoing intermetallic compound grinder, for example, of TiAl used in the examples of this invention.

Although not shown in the figure, the polishing of the gas phase synthesized diamond thin film progressed on the diamond grains in just one minute like the foregoing. The polishing performance of this composite intermetallic compound grinder was satisfactory just like the foregoing examples of the present invention.

Example 19

A composite intermetallic compound grinder consisting of a Ti—Al intermetallic compound (TiAl), a Ti—Cr intermetallic compound ($TiCr_2$), and a Zr—Co intermetallic compound ($ZrCo_{2s}$) as well as a composite intermetallic compound grinder consisting of a Ti—Ni intermetallic compound (TiNi) and a Zr—Ni intermetallic compound ($Zr_7Ni_{10}$) progressed in just one minute like the foregoing. The polishing performance of these composite intermetallic compound grinders were satisfactory just like the foregoing examples of the present invention.

Although not shown in the figures, the polishing of a gas phase synthesized diamond thin film and a sintered diamond compact produced under the same conditions as in the above example were carried out at room temperature.

The polishing conditions were as follows: the shape of the grinder was ϕ30 mm, the grinder rotation speed was 3000 rpm on a milling machine as a processing apparatus, and the polishing duration was one minute.

Example 20

A composite intermetallic compound grinder consisting of a Ti—Al intermetallic compound (TiAl)—2Cr (metal) and a Nb—Co intermetallic compound ($Nb_6Co_7$) was produced under the same conditions as in the above example, and polishing was carried out at room temperature for both a gas phase synthesized diamond thin film and a sintered diamond compact sintered under ultrahigh pressure.

The polishing conditions were as follows: the shape of the grinder was ϕ30 mm, the grinder rotation speed was 3000 rpm on a milling machine as a processing apparatus, and the polishing duration was one minute.

Figure 28:
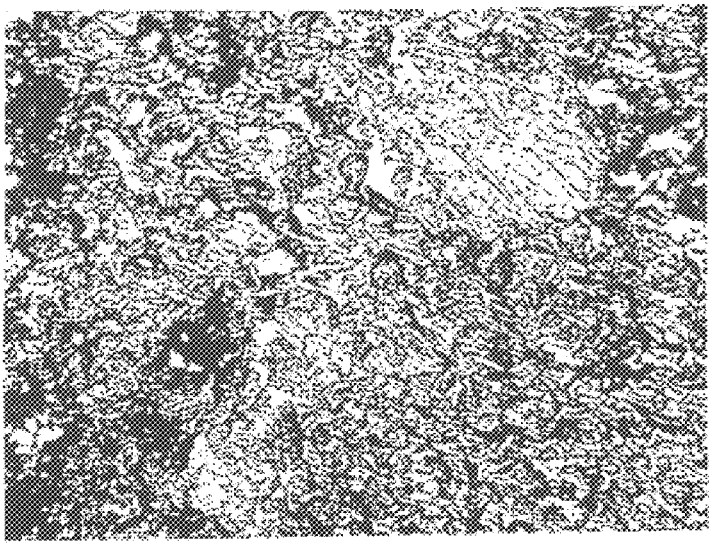
FIG. 28 in an optical microphotograph (with a magnification of ×625) of the surface of a sintered diamond compact after polishing on a composite metal-intermetallic compound polishing grinder consisting of Ti—Al intermetallic compound (TiAl)-2Cr (metal) and Nb—Co intermetallic compound ($Nb_6Co_7$).

The results of polishing the sintered diamond compact are shown in FIG. 28 which is an optical microphotograph with a magnification of ×625 of the sintered diamond compact after polishing.

The black portions designate the unpolished portions of diamond grains and the grayish and white portions the polished planes. As can be seen, polishing was progressed at the portions of diamond crystal grains, including the sintering additive portions, in just one minute. The polishing performance of this grinder was satisfactory just like the foregoing intermetallic compound grinders, for example, of TiAl used in the examples of this invention.

Although not shown in figure, the polishing of the gas phase synthesized diamond thin film satisfactorily progressed on the diamond grains in just one minute like the foregoing. The polishing performance of this composite intermetallic compound grinder was satisfactory just like the foregoing examples of the present invention.

Example 21

Polishing was carried out with the intermetallic compound grinder of Example 14 for a sintered diamond compact sintered under ultrahigh pressure synthesis using Ni and TiC as a binder.

The polishing conditions were as follows: the grinder rotation speed was 2250 rpm on a milling machine as a processing apparatus, and the polishing duration was 30 minutes at room temperature.

The polishing satisfactorily progressed both at the diamond crystal grain portions and at the binder portions in just 30 minutes.

The examination of the surface roughness after polishing revealed that there existed almost no step at grain/binder boundaries and an excellent polished plane, having a surface roughness of 0.5 $\mu$m or less was provided.

Although Ni and TiC were used as binders for the sintered diamond compact in this example, the same results were obtained when using the other binders according to the present invention.

Further, although the intermetallic compound grinder of Example 14 was used in this example, the same results were obtained when using the other grinders of the present invention.

The above grinders consisting of a composite intermetallic compound, including a simple metal substance, may be produced by using each individual component powder of the grinder as a starting material, or by mixing and sintering certain intermetallic compounds previously formed.

Although the present invention has been described in the examples mostly carrying out polishing at ordinary temperatures, it should be understood polishing can be carried out while applying heat. The polishing performance of the grinders of the present invention is further improved by the application of heat.

However, when heating is not particularly required or is undesirable to the subject of polishing, the polishing according to the present invention can be carried out at ordinary room temperature.

The grinders of the present invention are preferably produced by powder metallurgy techniques because the method readily enables the adjustment of components and does not cause segregation or coarsing of grain. A melting method can also be used because the method provides for easier production. The methods for polishing grinders are not limited to any specific ones; rather, they can be selected properly according to the specific applications.

Although the present invention has been described taking examples of relatively simple compositions, the grinders of the present invention may contain a simple metal substance (ie. form a composite), be a composite of a diamond grinder, or contain ceramics as well as the intermetallic compounds.

The present invention includes the grinders of the present invention, their parts, and any components capable of functioning as a grinder.

According to the present invention, single crystal or polycrystalline diamonds, gas phase synthesized diamond thin films and free-standing diamond films, and sintered diamond compacts can be effectively polished at low temperatures without causing cracks, fractures or degradation in quality therein by using a grinder whose main component is an intermetallic compound consisting of one kind or more of elements selected from the group of Al, Cr, Mn, Fe, Co, Ni, Cu, Ru, Rh, Pd, Os, Ir and Pt and one kind or more of elements selected from the group of Ti, V, Zr, Nb, Mo, Hf, Ta and W. Preferably the grinder is positioned into engagement with the diamond and is rotated, or moved relative thereto. In addition, preferably, the portions of the diamond subjected to polishing is heated to between 100–800° C. according to the situation.

According to the present invention, useful grinder life is increased and stable polishing performance is maintained. In addition, currently available apparatus, such as surface grinding apparatus, can be utilized, and polishing processing of three-dimensional shaped diamond thin film coating members can be efficiently accomplished.

According to the present invention, even the (111) plane of a single crystal can be readily polished. This was previously a very hard task, and people thought that no grinder could polish such a plane. Accordingly, a high performance single crystal diamond exhibiting excellent properties of both hardness and thermal conductivity can be obtained.

According to the present invention, a sintered diamond compact can also be readily polished. Sintered diamond compacts are typically utilized as a polishing or grinding tool, or as a material for various types of wear-resistant parts and electronic parts.

According to the present invention, a polished diamond can be obtained in which step (ie. roughness) of the polished plane at crystal grain boundaries are remarkably decreased. Accordingly, in polishing such diamonds, the operation becomes easier, polishing quality becomes more stable, and the polishing cost is lowered.

What is claimed is:

1. A tool for grinding and polishing diamond, comprising a grinder consisting essentially of an intermetallic compound consisting of at least one element selected from the group consisting of Al, Cr, Mn, Fe, Co, Ni, Cu, Ru, Rh, Pd, Os, Ir and Pt, and at least one element selected from the group consisting of Ti, V, Zr, Nb, Mo, Hf, Ta and W.

* * * * *

UNITED STATES PATENT AND TRADEMARK OFFICE

CERTIFICATE OF CORRECTION

PATENT NO. : 6,592,436 B1
DATED : July 15, 2003
INVENTOR(S) : Abe et al.

It is certified that error appears in the above-identified patent and that said Letters Patent is hereby corrected as shown below:

Column 3,
Line 30, "begins to bum when" should read -- begins to burn when --

Column 19,
Line 2, "as $4.0x10^{-2}$" should read -- as $4.0x10^{-12}$ --

Column 21,
Line 55, "compound ($Zr_7N_{10}$)" should read -- compound ($Zr_7Ni_{10}$) --

Column 23,
Line 2, "of '625 of the" should read -- of x625 of the --

Signed and Sealed this

Tenth Day of February, 2004

JON W. DUDAS
*Acting Director of the United States Patent and Trademark Office*